US005717444A

United States Patent [19]

Sugimoto et al.

[11] Patent Number: 5,717,444

[45] Date of Patent: Feb. 10, 1998

[54] SUCTION RECOVERY DEVICE AND INK JET RECORDING APPARATUS USING THE DEVICE

[75] Inventors: Hitoshi Sugimoto; Hirofumi Hirano; Yoji Ara; Masaharu Ikado, all of Yokohama, Japan

[73] Assignee: Canon Kabushiki Kaisha, Tokyo, Japan

[21] Appl. No.: 739,656

[22] Filed: Nov. 1, 1996

Related U.S. Application Data

[63] Continuation of Ser. No. 465,571, Jun. 5, 1995, abandoned, which is a continuation of Ser. No. 116,548, Sep. 7, 1993, abandoned, which is a continuation of Ser. No. 683,808, Apr. 11, 1996, abandoned.

[30] Foreign Application Priority Data

| | | | |
|---|---|---|---|
| Apr. 11, 1990 | [JP] | Japan | 2-095976 |
| Aug. 6, 1990 | [JP] | Japan | 2-208716 |
| Aug. 6, 1990 | [JP] | Japan | 2-208717 |
| Aug. 6, 1990 | [JP] | Japan | 2-208718 |

[51] Int. Cl.[6] ..... B41J 2/165

[52] U.S. Cl. ..... 347/29; 347/30

[58] Field of Search ..... 347/29, 30, 31, 347/32

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,364,065 | 12/1982 | Yamamori et al. | 347/29 |
| 4,410,900 | 10/1983 | Terasawa | 346/140 R |
| 4,459,600 | 7/1984 | Sato et al. | 346/140 R |
| 4,463,359 | 7/1984 | Ayata et al. | 346/1.1 |
| 4,506,277 | 3/1985 | Terasawa | 346/140 R |
| 4,510,510 | 4/1985 | Terasawa | 346/140 R |
| 4,543,591 | 9/1985 | Terasawa | 346/140 R |
| 4,558,333 | 12/1985 | Sugitani et al. | 346/140 R |
| 4,571,600 | 2/1986 | Hara | 346/140 R |
| 4,586,058 | 4/1986 | Yamazaki et al. | 346/140 R |
| 4,600,931 | 7/1986 | Terasawa | 346/140 R |
| 4,707,714 | 11/1987 | Rosenthal | 347/29 |
| 4,723,129 | 2/1988 | Endo et al. | 346/1.1 |
| 4,728,970 | 3/1988 | Terasawa | 346/140 R |
| 4,734,719 | 3/1988 | Suzuki | 346/140 R |
| 4,739,340 | 4/1988 | Terasawa | 346/1.1 |
| 4,740,796 | 4/1988 | Endo et al. | 346/1.1 |
| 4,819,012 | 4/1989 | Kiyohara et al. | 346/140 R |
| 4,908,636 | 3/1990 | Saito | 346/140 R |
| 4,926,196 | 5/1990 | Mizoguchi et al. | 346/140 R |
| 4,951,066 | 8/1990 | Terasawa et al. | 346/140 R |
| 4,952,947 | 8/1990 | Kyoshima | 346/140 R |
| 4,970,534 | 11/1990 | Terasawa et al. | 346/140 R |
| 5,086,305 | 2/1992 | Terasawa | 346/1.1 |

FOREIGN PATENT DOCUMENTS

| | | | |
|---|---|---|---|
| 0032973 | 2/1982 | Japan | 346/140 PD |
| 59123670 | 7/1984 | Japan . | |
| 59138461 | 8/1984 | Japan . | |
| 61277456 | 12/1986 | Japan . | |
| 62111751 | 5/1987 | Japan . | |

*Primary Examiner*—N. Le

*Attorney, Agent, or Firm*—Fitzpatrick, Cella, Harper & Scinto

[57] ABSTRACT

A suction recovery device of ink jet recording apparatus comprises a cap which can contact with or separate from a face formed with discharge ports for recording by discharging the ink, the cap communicating to a suction system for performing the suction recovery through the discharge ports via the cap, said cap having a groove portion for guiding ink, and formed of an elastic material integrally with an ink communication member for communicating to the suction system via a suction port provided on an inner wall of the cap, and said suction system having a cylinder and a piston reciprocating within the cylinder, and having disposed ink absorbing member in an ink exhaust portion within the cylinder.

51 Claims, 26 Drawing Sheets

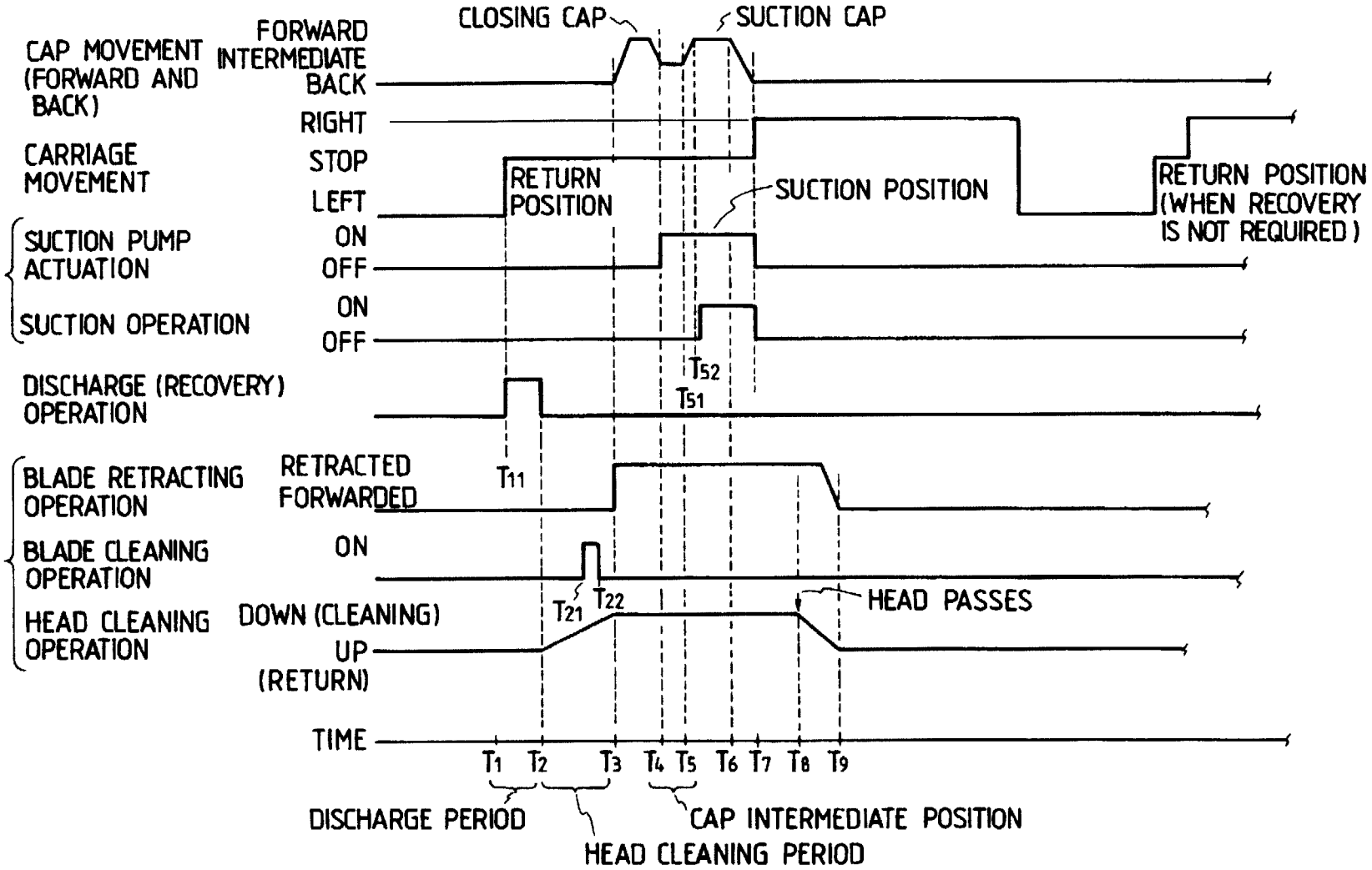
FIG. 17
CAP MOVEMENT (FORWARD AND BACK)
FORWARD
INTERMEDIATE
BACK
CARRIAGE MOVEMENT
RIGHT
STOP
LEFT
SUCTION PUMP ACTUATION
ON
OFF
SUCTION OPERATION
ON
OFF
DISCHARGE (RECOVERY) OPERATION
BLADE RETRACTING OPERATION
RETRACTED
FORWARDED
BLADE CLEANING OPERATION
ON
HEAD CLEANING OPERATION
DOWN (CLEANING)
UP (RETURN)
TIME
CLOSING CAP
SUCTION CAP
RETURN POSITION
SUCTION POSITION
RETURN POSITION (WHEN RECOVERY IS NOT REQUIRED)
HEAD PASSES
T11
T52
T51
T21
T22
T1
T2
T3
T4
T5
T6
T7
T8
T9
DISCHARGE PERIOD
HEAD CLEANING PERIOD
CAP INTERMEDIATE POSITION

SUCTION RECOVERY DEVICE AND INK JET RECORDING APPARATUS USING THE DEVICE

This application is a continuation of application Ser. No. 08/465,571 filed Jun. 5, 1995, abandoned which is a continuation of application Ser. No. 08/116,548 filed Sept. 7, 1993, abandoned which is a continuation of application Ser. No. 07/683,808 filed Apr. 11, 1991, abandoned.

BACKGROUND OF THE INVENTION

1. Field of the invention

The present invention relates to an ink jet recording apparatus, and more particularly to an ink jet recording apparatus having a suction recovery device.

2. Related Background Art

Conventionally, a recording apparatus for recording onto a recording medium such as a paper or OHP sheet (thereafter referred to as a recording sheet or simply as a paper) has been proposed in the form in which the recording head is mounted in accordance with any of various recording methods. The recording head is one in accordance with any of wire-dot, thermal, thermal imprint and ink jet recording methods.

Particularly, the ink jet recording method is one in which the ink is directly discharged onto a recording sheet, and has been noted by virtue of its inexpensive running cost and quiet recording method.

In a recording apparatus with such ink jet recording method, when some air bubbles or dust has entered inwardly into discharge ports, or thickening of ink inappropriate for discharging or recording has occurred owing to the evaporation of ink solvent, the processing (suction recovery processing) for removing improper discharge factors must be performed by refreshing the ink with the suction recovery device because the recording head has generally fine discharge ports arranged.

One form of such suction recovery means is provided with a cap for covering a discharge port formation face of recording head and a pump for exerting the suction force to the cap in communication therewith. Removal of improper discharge factors is accomplished in such a way of discharging ink by driving energy generation elements for discharging ink which are located inwardly of discharge ports, with the cap being opposed to the discharge port formation face, or forcedly discharging ink by suction through the discharge ports with the exertion of suction force, with the discharge port formation face being covered by the cap.

The present invention provides insight into and resolves new technical problems in the aforementioned suction recovery device.

In order to perform the suction recovery processing smoothly, received ink within cap must be sucked smoothly into the waste ink tank. In this case, such a situation must not arise that received ink within cap remains without being sucked, or sucked ink leaks out of the equalizing mechanism for lack of stable contact between cap and discharge port face.

However, if the cap constitution is inadequate, received ink can not be exhausted completely from the cap, but may remain therein. That is, whereas such an exhaust processing is performed in such a manner that the cap is separated away from the recording head, and received ink is sucked through the suction port with the cap inner space opening to the atmosphere, if received ink is not adequately guided into the suction port, the air is only sucked ineffectively.

Residual ink within the cap is apparently undesirable because it may leak out into the interior of apparatus for some reason, or stiffen within the cap to degrade the performance of cap remarkably.

Also, the equalizing mechanism has the following problems. A constitution in which the cap member made of at least an elastic body is contacted with or directly supported by the support member was used excellently during early service period, because an ink exhaust passage of the elastic cap member and an ink guide passage of the support member are communicated with each other. However, in a process for confirming the product reliability, observation of product condition indicated that a slight amount of ink leakage had occurred in the contact area as above described. This occurred even though sufficient measures had been considered in the design stage. The inventors found a following problem in pursuing that cause. That is, with a constitution in which the cap member is supported and equalized for the discharge port formation face of recording head so that a contact portion of the cap member is brought into stable contact with the discharge port formation face without gap, the face accuracy of cap with the discharge port formation face was sometimes degraded so that contact was made rather unevenly.

SUMMARY OF THE INVENTION

An object of the present invention is, in view of aforementioned conventional technical problems, to resolve those problems, and thus to provide a reliable ink jet recording apparatus with a suction recovery device for clearingly waste ink smoothly.

A further object of the present invention is to provide a suction recovery device and an ink jet recording apparatus with the device, having support means for supporting a cap member which can provide securely both the cap face accuracy and the equalization ability for a discharge port formation face.

A further object of the present invention is to provide a suction recovery device and an ink jet recording apparatus with the device in which a cap member is constructed so that cleanest ink does not remain within cap.

Another object of the present invention is to provide a suction recovery device and an ink jet recording apparatus with the device in which ink will not remain within the cap regardless of the attitude of the cap or apparatus.

Another object of the present invention is to provide a suction recovery device and an ink jet recording apparatus with the device in which waste ink produced during the recovery operation or received within the suction recovery device in said operation can be reliably transferred into a waste ink tank.

Another object of the present invention is to provide a suction recovery device and an ink jet recording apparatus with said device having a cap construction in which ink within the cap can be all be completely removed after the suction recovery operation, and contamination of the discharge port face due to residual ink or dust such as paper dust accumulated within the cap can be eliminated.

Another object of the present invention is to provide an ink jet recording apparatus comprising a cap which can contact with/separate from a face formed with discharge ports of the recording head having discharge ports for recording by discharging the ink, and a suction system for performing the suction processing through said discharge ports via said cap, wherein an ink communication member for communicating with the suction system of the cap is formed of an elastic member integrally therewith.

Another object of the present invention is to provide an ink jet recording apparatus comprising a cap which can contact with/separate from a face formed with discharge ports of recording head having discharge ports for recording by discharging the ink, and a suction system for performing the suction processing through the discharge ports via said cap, wherein the cap has a channel portion for guiding ink associated with a suction port provided on its inner wall face to perform said suction.

Another object of the present invention is to provide an ink jet recording apparatus comprising a suction pump capable of improving the ink discharge clearing the ink through discharge ports of the recording head discharging ink through the discharge ports, wherein the suction pump has a cylinder and a piston reciprocating within the cylinder, and having disposed within the cylinder an absorbing member on an ink exhaust portion.

BRIEF DESCRIPTION OF THE DRAWINGS

FIG. 17 is a timing chart for explaining the sequence during predischarge and suction recovery according to the present invention.

DETAILED DESCRIPTION OF THE PREFERRED EMBODIMENTS

An example of the present invention will be described in detail with reference to the drawings.

Figure 1:
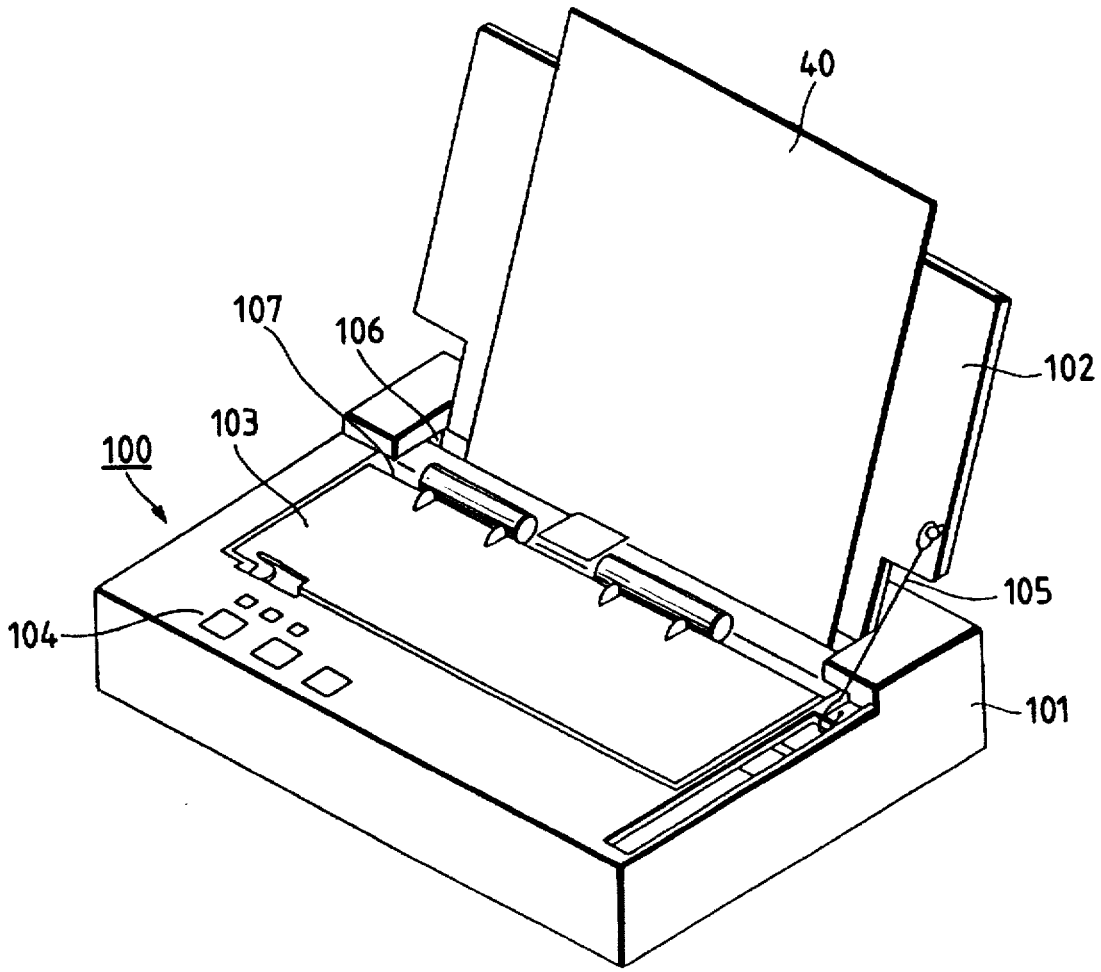
FIG. 1 is an external perspective view showing one example of an ink jet recording apparatus according to the present invention.
Figure 2:
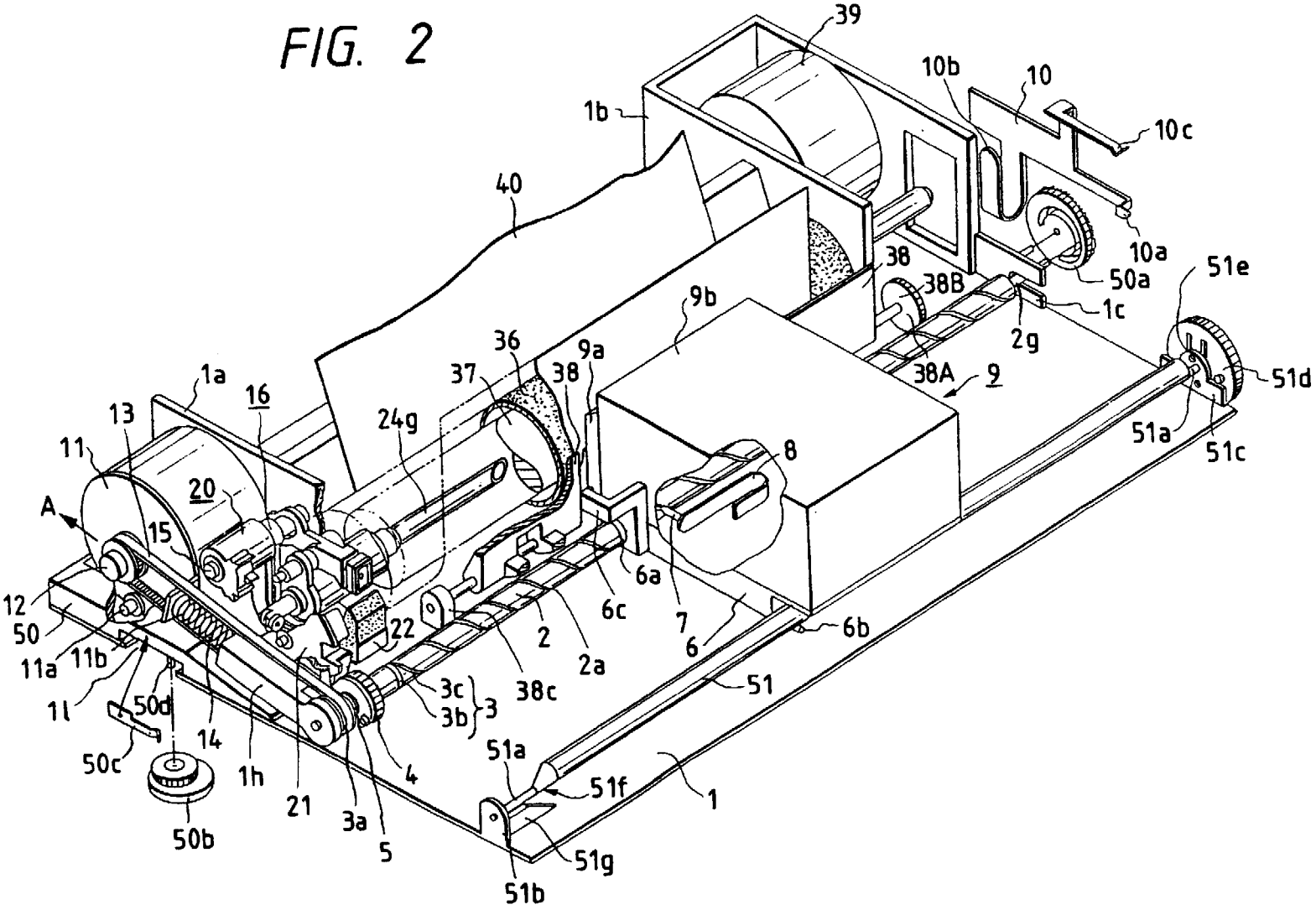
FIG. 2 is a perspective view showing a main portion of the apparatus as shown in FIG. 1, with a cover removed.
Figure 3A:
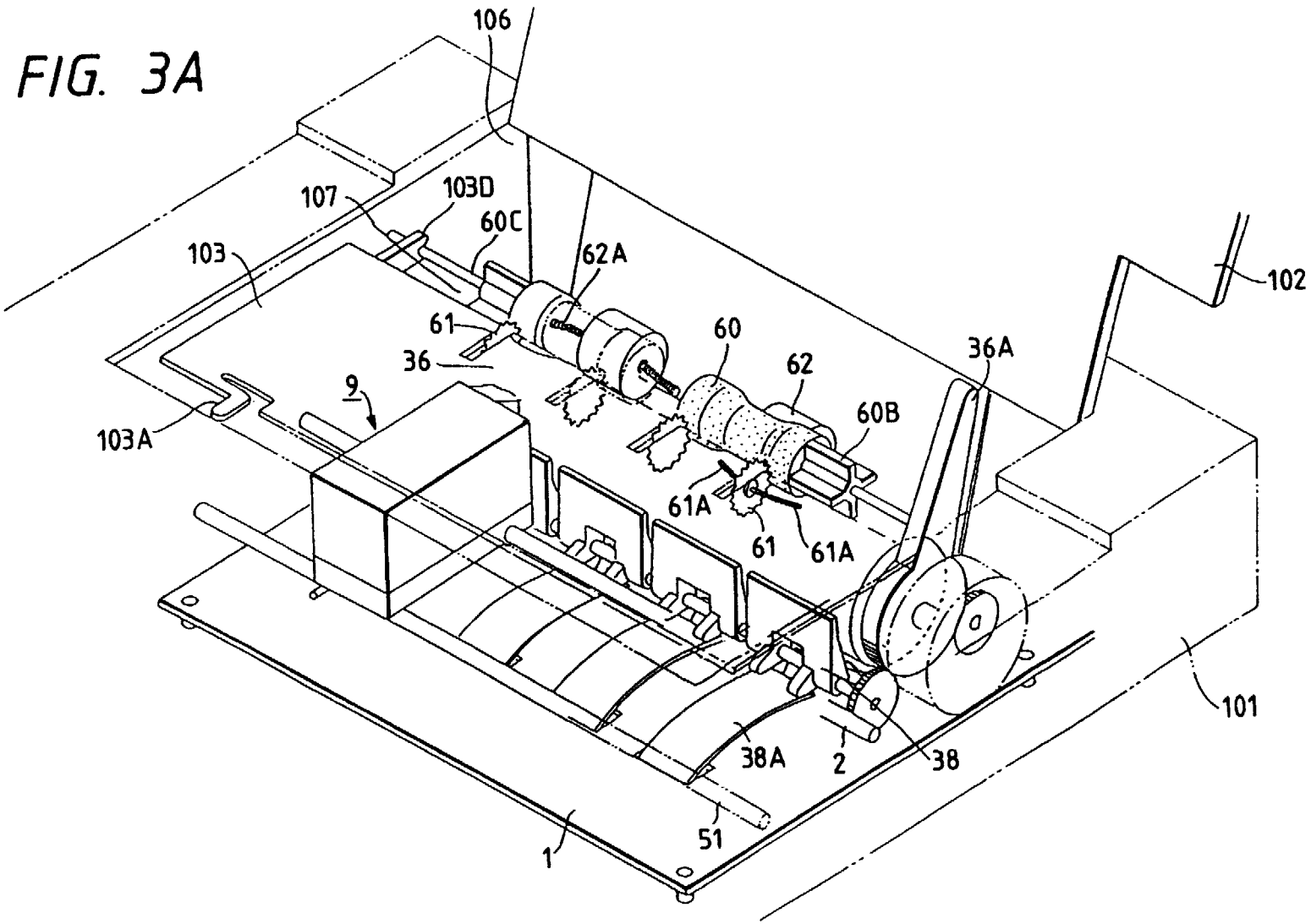
FIG. 3A is a perspective view mainly showing a paper exhaust system of the apparatus as shown in FIG. 1.
Figure 3B:
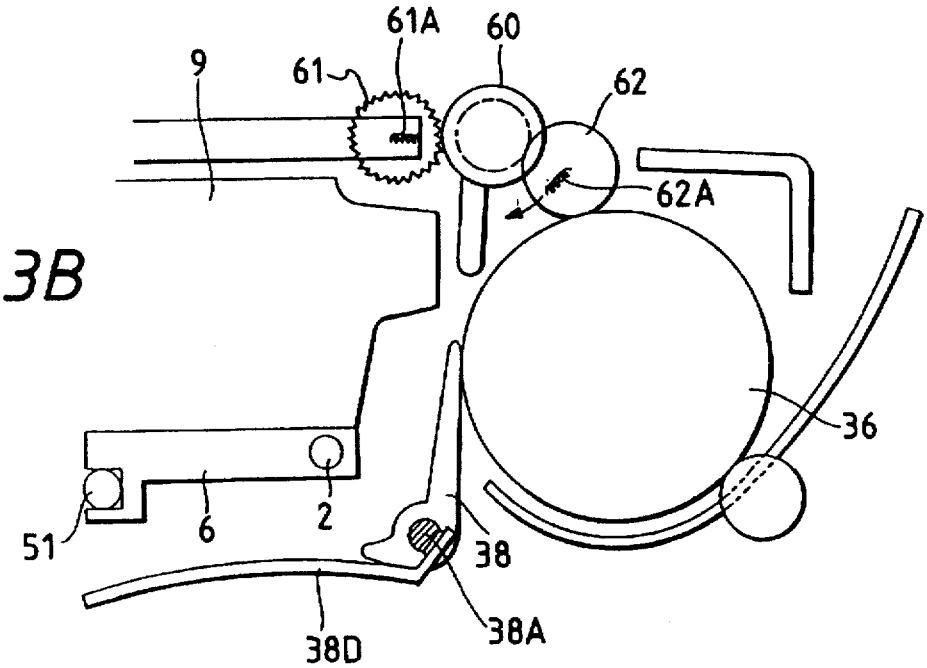
FIG. 3B is a side view of the apparatus as shown in FIG. 3A.

FIG. 1 is an external perspective view of an ink jet recording apparatus in accordance with one example of the present invention, FIG. 2 is a perspective view of the main portion of the apparatus as shown in FIG. 1, with a cover removed, and FIGS. 3A and 3B are views mainly showing a paper exhaust system of apparatus as shown in FIG. 1.

In FIG. 1, 100 is an ink jet recording apparatus, in which the apparatus 100 is placed as shown in the same figure, or vertically placed as will be described later, during use, and which is of a comparatively small size.

101 is an apparatus housing, 102 is an outer cover, and 103 is an inner cover; when not used, the outer cover 102 is overlapped on the inner cover 103 so that the apparatus 100 is made compact. Thereby, a user can transport the recording apparatus, for example, by containing it in a special bag.

The outer cover 102 can be also used as a paper feed guide for a recording sheet 40 as shown in the figure, in which 106 as indicated in the figure becomes a paper feed opening. Further, the outer cover 102 is also used as a paper exhaust tray as will be described later.

In either of the above cases, 107 as indicated in the figure becomes a paper exhaust opening.

105 is a position fixing hook for upper cover 102, and 104 is the operation key and display section.

Next, the constitution of essential parts for the apparatus will be described with reference to FIG. 2.

In FIG. 2, 1 is a chassis, behind of which are found a left-hand plate 1*a* and a right-hand plate 1*b* which also serve as the guide for a recording medium such as a paper. The chassis 1 is provided with a motor mounting hole for rotatably supporting a carrier motor as will be described, but not shown.

1*h* is a lead arm for rotatably supporting a lead screw in the axial and radial directions as will be described, and supported in a bearing portion (not shown).

2 is the lead screw which is formed with a lead groove 2*a* at a predetermined pitch, corresponding to a range of recording. On a carrier home position side of the lead screw 2A, a position groove 3*b* for setting the position of capping and discharge recovery is formed around the periphery of cross section perpendicular to a screw axis. The lead groove 2*a* and the position groove 3*b* are made continuous via an introduction groove 3*c*.

A shank 2*g* is provided on a right end portion of the lead screw 2, and a shank is also provided on its left end portion, in which the shanks are fitted into bearing portions provided on a front side plate 1*c* and the lead arm 1*b*, respectively, and rotatably supported therein. 3 is a lead pulley provided on the shaft of lead screw 2 and includes the grooves 3*b*, 3*c* as above described, on an end portion of which is provided a pulley 3*a*. And the driving force is transmitted to the pulley 3*a* via a timing belt 13 from motor 11.

The shank 2*g* on right end portion of lead screw 2 engages slidably into a lateral slot of guide plate 1*c* connecting with a right side plate 1*b* of chassis and the chassis 1, and is biased in a thrust direction by a presser portion 10*a* of leaf spring 10, and further engages into a cam groove of cam groove plate 50*a* rotatably supported in an axle provided on the guide plate 1*c*. Mating teeth are formed around the periphery of cam groove plate 50*a*, in which its engagement with a ratchet pawl 10*c* of leaf spring 10 allows the cam groove plate 50*a* to be stopped at a predetermined position. As a result, the shank 2*g* engaging into the cam groove has its position fixed with respect to the lateral slot of guide plate 1*c*, and therefore, the position on the right end portion of the apparatus. This construction is used for adjusting the recording head and platen, as will be described later.

4 is a clutch gear supported slidably in the axial direction to the lead pulley 3, and engaged by a key provided on the lead pulley 3, as will be described, in the rotational direction, so as to transmit the rotation force of lead screw 2. 5 is a clutch spring, which is a compression spring urging the clutch gear 4 in the direction of lead groove. Note that member for restraining the clutch gear 4 within a predetermined range in the axial direction is formed between the clutch gear 4 and the lead pulley 3.

6 is a carrier slidingly mounted on the lead screw 2. 6*a* is a presser portion for pressing an end face of the clutch gear 4 and formed integrally on a left side of carrier. 7 is a lead pin engaging the lead groove 2*a* of lead screw 2 and guided in a guide hole (not shown) of carrier 6 with respect to the direction of pressing. 8 is a lead pin spring with its one end attached to the carrier 6, and the other end pressing on the lead pin 7.

9 is a recording head mounted on the carrier 6, in this example, in the form of a cartridge type made detachable by integrating a head element 9*a* for discharging ink and an ink tank 9*b* which is an ink supply source, i.e., a disposable type which is exchangeable when the ink is used up. As discharge energy generation elements for acting transferring the discharge energy to the ink disposed in the head element 9*a*, electricity-heat or electromechanical converters are used, and preferably, the former is used because higher density packaging is possible and manufacturing process is simple.

6*c* is a hook secured to one portion of carrier 6 and used to stop securely in place such as a capping position of recording head 9 during the movement of carrier 6, as will be described later.

51 is a carrier guide shaft slidably engaged by a guide pin 6*b* provided on a rear end portion of carrier 6. The guide shaft 51 has an eccentric shaft 51*a*, as will be described later, which is rotatably carried by side plates 51*b*, 51*c* provided on end portions of chassis 1. Further, the end portion of shaft 51*a* carried by side plate 51*c* is fixed to a positioning knob 51*d*, and the engagement of a projection on the knob 51*d* into a hole 51*e* on side plate 51*c* permits the rotation position.

Figure 4A:
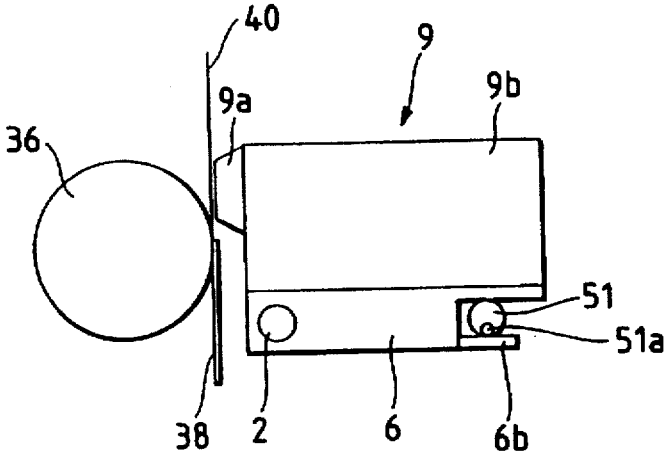
FIGS. 4A and 4B are side views showing one example of a recording head adjacent to recording sheets, respectively.
Figure 4B:
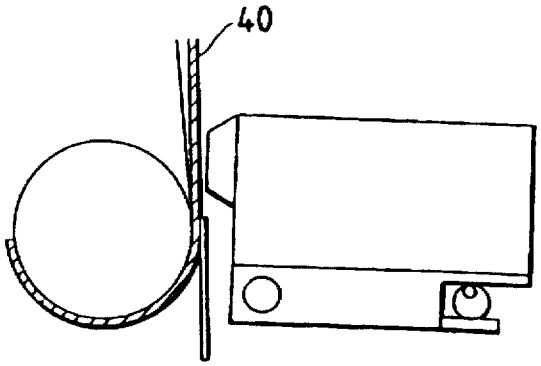

As shown in FIGS. 4A and 4B, the above constitution is intended to make appropriate the clearance between a recording plane of recording sheet 40 and discharge ports of head element 9*a*. That is, by rotating the knob 51d manually, the shaft 51 can be fixed to a position where the distance between the shaft 51*a* and the pin 6*b* is minimum, as shown in FIG. 4A, or a position where that distance is maximum, as shown in FIG. 4B. Correspondingly, the recording head 9 is rotated around a rotation axis of lead screw 2, and fixed to are position (FIG. 4A) for use with to plain paper in which recording sheet 40 is comparatively thin, or another position (FIG. 4B) having a larger clearance which is corresponding to comparatively thick recording sheet such as an envelope.

However, the above constitution is one corresponding to recording sheet during recording. That is, in the suction recovery processing, the recording head 9 is moved to a position for recovery processing as shown to the left in FIG. 2. At this time, the recording head 9 and the recovery system must be always placed in a predetermined positional relation. Accordingly, during the suction recovery operation, the recovery head 9 is required to take a predetermined position, irrespective of the position as shown in FIG. 4A or 4B. Such a constitution is shown in FIGS. 5A and 5B.

Figure 5A:
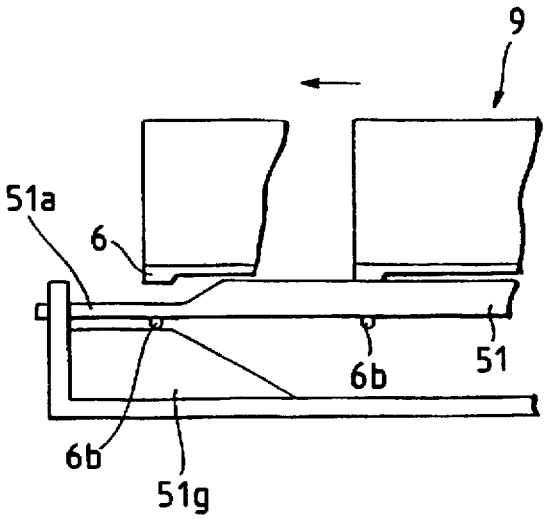
FIGS. 5A and 5B are rear views showing one example of a recording head at a home position in correspondence with recording sheets, respectively.
Figure 5B:
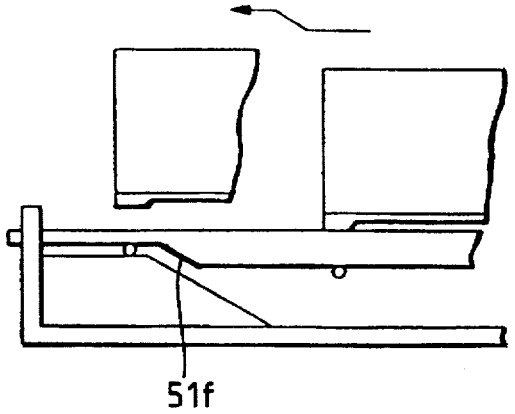

FIGS. 5A and 5B show views corresponding to those of FIGS. 4A and 4B, respectively.

In FIG. 5A, the shaft 51*a* and the pin 6*b* are engageable without changing the height of the engagement position of the shaft 51 with the pin 6*b*. At this time, in order to maintain the height of its engagement position, a parallel plane of trapezoidal cam 51*g* is caused to engage the pin 6*b*.

In FIG. 5B, when the recording head 9 moves and the pin 6*b* engages the shaft 51*a*, the height of engagement position of the pin 6b changes. Therefore, the shaft 51 is provided with a taper portion 51f, and correspondingly, the trapezoidal cam 51g is provided with a taper surface. Thereby, the height of engagement position of the pin 6b with the shaft 51 (taper portion 51f, shaft 51a) is changed, and then maintained.

With the above construction, when the recording head 9 reaches the position of the suction recovery system, which is a predetermined height, accordingly, a predetermined position relation with the recovery system can be always maintained.

Note that the rotation fixed positions of recording head 9 is not limited to two positions as above mentioned, but may take fixed intermediate position to cope with recording sheet of other thicknesses. In this case, engageable positions between the projection of knob 51d and the hole 51e of side plate 51c are needed to increase the number of positions that can be maintained.

The rotation of knob 51d is not limited to manual operation, but the knob 51d may be rotated using the driving force of a paper feed motor or the like, in accordance with the key input corresponding to recording sheet for use, for example.

Referring to FIG. 2 again, 11 is a carrier motor consisting of a pulse motor, for example, on front and rear faces of which rotation pins 11a (that on rear side is not shown) are provided in lower portions in alignment therewith, and fitted for free rotation into motor mounting holes provided on a recovery system base 50 movable on the chassis 1. It is of course sufficient that the rotation pins are provided on the recovery system base 50 and the mounting holes are provided on the motor. Carrier motor 11 is mounted for rotation around the rotation pins 11a. 11b is a spring shoe formed integrally with the carrier motor 11, and is parallel to motor shaft for receiving a motor spring as will be described later. The spring shoe is formed with a cylindrical projection to which an end portion of coiled motor spring 14 is fixed.

12 is a motor pulley secured on the motor shaft of carrier motor 11. 13 is a timing belt 13 extended under tension between the motor pulley 12 and the lead pulley 3a provided on the shaft of lead screw 2. In this example, motor spring 14 is a compression spring, which is attached between one end of lead arm 1h and the spring shoe 11b of carrier motor 11, thereby urging the carrier motor 11 in the direction of arrow A as indicated in the figure, and applying a tensile force to the timing belt 13.

15 is a set shaft to which means for cleaning discharge port face stood on a side plate, not shown, fixed to the base 50, the cap and a so-called recovery mechanism involved in the suction recovery are mounted.

By the way, as previously described, the positional relation between the recovery mechanism and the recovery head 9 is important. For example, in order to facilitate the feature of blade wiping over the discharge port face of the recording head 9, the positional relation with respect to the discharge port face is important, and the spacing between the cap and the discharge port face is important to enable the capping function of the discharge port face. Accordingly, the positional relation between the recovery mechanism and the recording head 9 is desirably maintained constant at all times.

On the other hand, the recording head 9 performs recording while moving along the lead screw 2 by transmitting its driving force via the lead screw 2. At this time, it is clear that the distance between recording sheet 40 and the discharge ports of recording head 9 should be equal for any position of movement. Accordingly, an adjustment mechanism for adjusting the distance of the recording head 9 to recording sheet can be provided to let the recording head move parallel the recording sheet, but this adjustment may destroy a certain positional relation with respect to the recovery system as above described.

Thus, in this example, the recovery system base 50 on which the carrier motor 11 and recovery 1 mechanism as (will be described) are provided is made movable with respect to the chassis 1. The position of lead screw 2 can be adjusted on both end portions using the movement of the base 50 and the adjustment of cam groove plate 50a as previously described, so that the recording head 9 can move parallel to recording sheet 40. The detail of the mechanism in the base 50 for such purpose is shown in FIG. 6.

Figure 6:
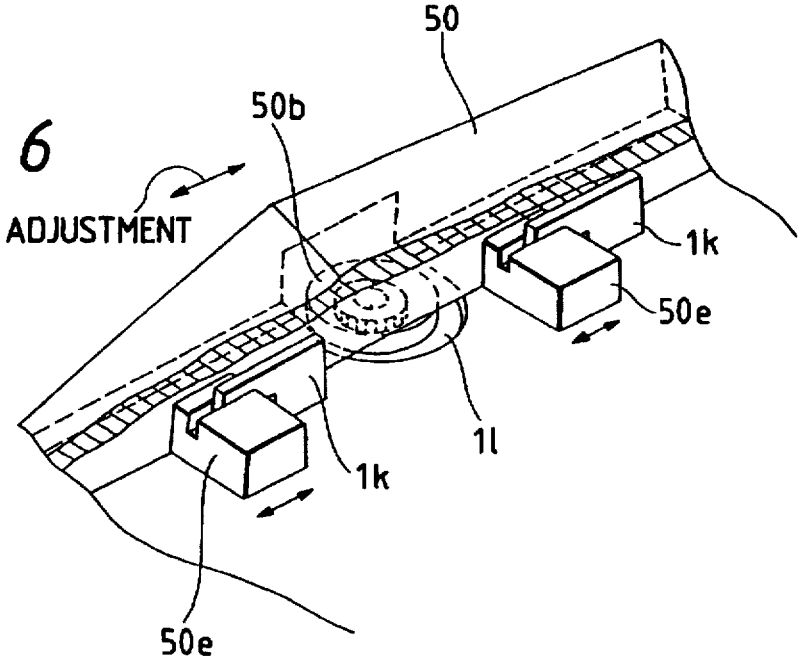
FIG. 6 is a partly broken perspective view showing one example of the engagement state of a base having mounted a recovery mechanism with a chassis.

FIG. 6 is a perspective view, partially broken away, of recovery system base 50 observed from the direction opposite to that of FIG. 2.

In the figure, 50e is a guide groove member fixed to a side face of groove provided on a back side of the base 50, wherein the engagement of a groove of the member 50e with a guide portion of hook-type guide member 1k can restrain the moving direction of base 50, and prevent the lifting of the base 50 from the chassis 1.

In the above mechanism, by rotating a cam plate 50b around an axis 50d attached to the base 50, its cam face is contacted with either of faces of cam groove 11 in the chassis 1, and pressed thereto, as shown in detail in FIG. 2. Then, the base 50 moves in a direction guided by the member 50e and member 1k due to a reaction against the pressing force.

Note that the above cam can be constructed such that the cam plate is rotated around a predetermined shaft by operating the shaft engageable with a predetermined cam groove formed on the cam plate.

Along with this movement, the carrier motor 11 and the driving system for driving the motor 11, i.e., timing belt 13, pulley 3, 12, lead screw 2, and the recovery mechanism mounted on the base 50 move so as to adjust the one end position of lead screw 2.

On the other hand, the position adjustment for the other end of lead screw 2 is performed by rotating the cam groove plate 50a.

With the above adjustment, the lead screw 2 can be made parallel to recording sheet, and accordingly, the recording head can move parallel to recording sheet.

Note that this adjustment is carried out assembler boots in a manufacturing process for recording apparatus, but this adjustment also can be made on the user side, for example, in the repair after long-term service of apparatus.

Next, means for improving the discharge port formation face which is one of the recovery mechanisms will be described with reference to FIG. 2 and FIGS. 7A–7C.

16 is a blade lever (see FIG. 7A), a boss portion 16a of which is rotatably mounted on a set shaft 15. 16b is an arm portion and 16c is a hook portion. 17 is a blade for wiping over the discharge port formation face, and formed of an elastic member such as silicone rubber or chloroprene (CR) rubber. 18 is a blade shaft for clamping the blade 17 on central portion parallel to the rotation axis, and rotatably attached to the blade lever 16. 18a is a rotation tab integrally formed with the blade shaft 18. 19 is an ink carrier formed of hydrophilic porous material (such as a plastic sintered body, or urethane foams) and secured to the blade lever 16. Note that the blade 17 and the ink carrier 19 are disposed at places where they are overlapped by the cap, as will be described later.

20 is a set lever rotatably mounted on the set shaft 15. 20*a*, 20*b* are stop teeth provided on the set lever 20, 20*c* is a start tooth, and 20*d* is a rotation tooth, the tooth thickness of start tooth 20*c* being about one half that of other teeth. 20*e* is an arm portion, including a set plane 20*f* and a reset plane 20*g* formed by cutting away its part in a direction of plate thickness, to which the rotation tab 18*a* of the blade shaft 18 mounted on the blade lever 16 is fitted for the driving.

21 is a timing gear rotatably mounted on the base 50 by a support member, not shown.

Figure 7A:
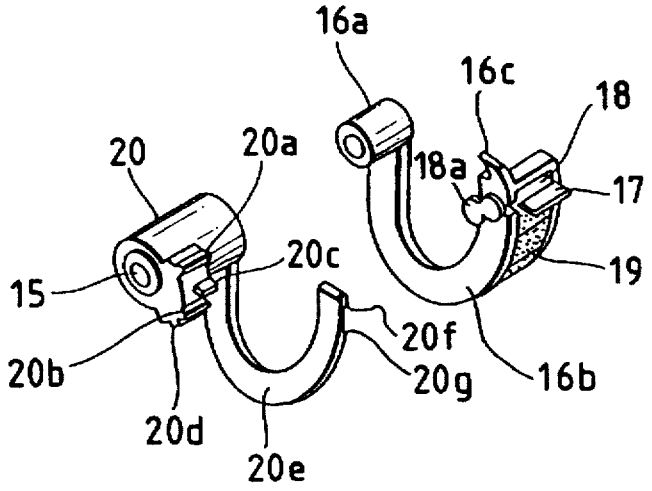
FIGS. 7A–7C are partial perspective views showing one example of a blade and an ink carrier unit for recording head.
Figure 7B:
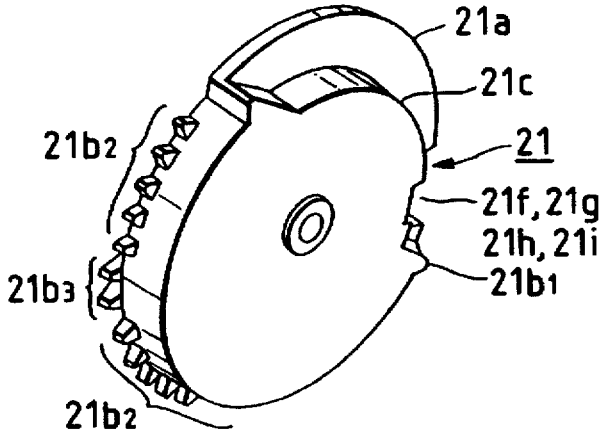

The timing gear 21 is formed with a stop cam 21*a* for engaging the stop teeth 20*a*, 20*b* of set lever 20 on a part of its external periphery, as shown in FIG. 7B. Also, three types of driving teeth $21b_1$, $21b_2$, $21b_3$, partially omitted, are formed, and further, a cap cam 21*c* for swinging cap lever as will be described later is formed. In addition, a piston set cam 21*f* for pressing a piston of pump as will be described later is formed as a face cam, and a piston reset cam 21*g* is integrally formed corresponding to the piston set cam 21*f* and spaced by a predetermined distance.

Figure 7C:
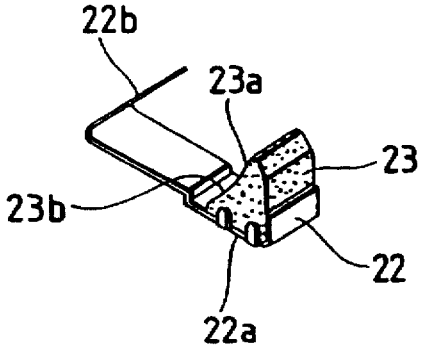

22 is an ink absorbing spring fixed to a predetermined position of base 50, and having an absorbing member holding portion 22*a* and a spring portion 22*b* for rotating the pump as will be described later, as shown in FIG. 7C. 23 is an ink absorbing member formed of a hydrophilic porous material like the ink carrier 19 as previously described. The ink absorbing member 23 is formed with a wipe-over portion 23*a* with which the blade 17 as previously described is brought into contact, and an absorbing face 23*b* contacted by the ink carrier 19 to pass and receive ink in a lower portion thereof. Note that the absorbing member holding a portion of ink absorbing member spring 22 is urged upward with a slight elasticity, and stopped at a predetermined position by a stopper, not shown. Therefore, when the ink carrier 19 as previously mentioned is contacted, the ink absorbing member 23 is displaced downward by the flexing of ink absorbing member spring 22 so as to secure the contact state.

Next, a recovery unit, which is one of the recovery mechanisms, will be described mainly with reference to FIGS. 8 and 9.

In FIGS. 8A, 8B and 9, 24 is a cylinder having a cylindrical section 24*a*, a piston absorbing member 241 as will described later, and a cylinder flow passage 24*b* for carrying a flow passage absorbing member 242, wherein a portion into which the flow passage absorbing member 242 (as will be described) is fitted has partially formed a projection 24*c* extending in the axial direction so as to provide a void in the axial direction between an external periphery of flow passage absorbing member and a bore of cylinder flow passage. 24*d* is a cap lever carrier formed to be fitted thereinto by a lever seal, as will be described. 24*e* is an ink flow passage which opens at a predetermined position within the cylinder 24*a*. 24*f* is a rotation lever formed integrally with the cylinder 24, and having the rotation force applied by a spring portion 22*b* of ink absorbing member spring 22 as previously described. Note that an extension spring may be also used to apply the rotation force.

Figure 9:
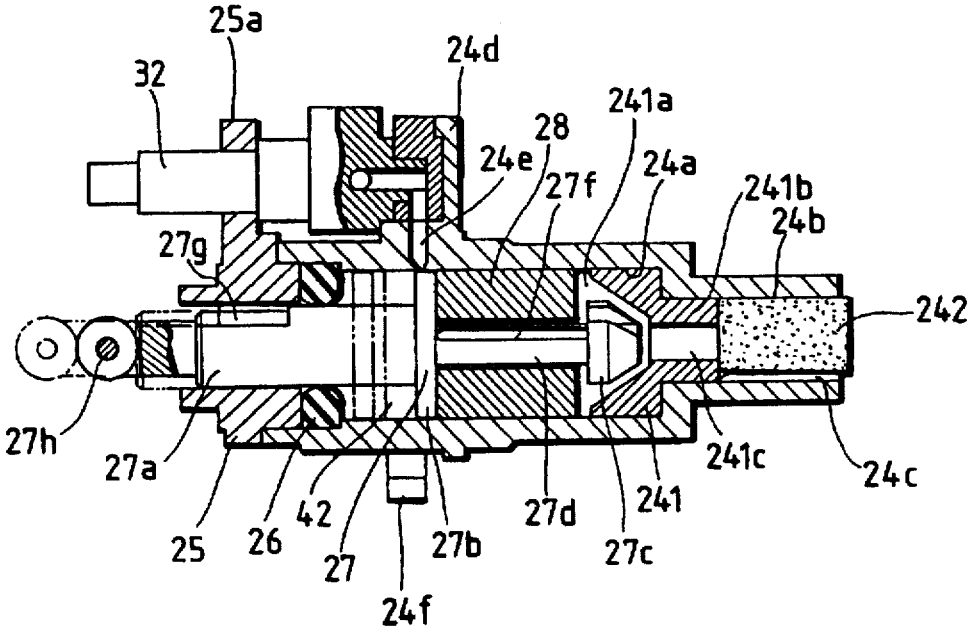
FIG. 9 is a cross-sectional view of a suction pump and its peripheral portion in a suction circuit system according to the present invention.

241 is an absorbing member provided on an ink exhaust portion within the cylinder on the right hand of piston as shown in FIG. 9, wherein it is formed of a hydrophilic porous material (i.e., a sintered compact from fine grains of polyolefine, or urethane foams) and fitted into the cylinder flow passage 24*b* of cylinder 24 as previously described. This piston absorbing member 241 may be secured to the cylinder 24, or conversely, fitted loosely with play. The piston absorbing member 241 is formed with a substantially conical opening portion 241*a* slightly larger than an edge contour of the piston shaft as will be described, a support portion 241*b* fitted into the cylinder flow passage 24*b* as previously described, and an air bleed 241*c*.

242 is a flow passage absorbing member fitted into the cylinder flow passage 24*b* as previously described, wherein the total length is set so that its one end is in contact with an end face of piston absorbing member 241, and the other end projects by a slight amount from an edge of the cylinder 24 to come into contact with a waste ink absorbing member as will be described. The flow passage absorbing member 242 is formed of a porous material containing communication pores with the elasticity such as melamine or urethane foam.

25 is a cylinder cap secured to an end portion of cylinder 24 with a press fitting or adhesive. 25*a* is a lever guide disposed at a position opposed to the cap lever carrier 24*d* of cylinder 24 as previously described. 26 is a piston seal fitted into cylinder 241, wherein its inner diameter is made slightly smaller to obtain a predetermined pressure welding force with the piston shaft as will be described. Also, lubrication coating may be applied on its surface to reduce the sliding force of piston shaft 27.

27 is the piston shaft, which is formed with an operation shaft 27*a*, a piston presser 27*b*, a piston carrier 27*c*, a connecting shaft 27*d*, and a channel 27*f* serving as an ink flow passage along the connecting shaft 27*d*. 27*g* is a rotation stop formed as a groove in the operation shaft 27*a*. And a bearing portion 27*h* is provided on an end face of operation shaft 27*a*.

28 is piston, formed in a cylindrical shape and larger by a predetermined amount than an inner diameter of the cylinder 24, using a rubber such as NBR or CR, wherein it is adequately compressed when inserted into the cylinder 24. A surface where an external circumferential surface and a piston presser 27*b* for piston shaft 27 are in contact is desirably made smooth, but may be provided with one or more ribs to secure the sealing property. The total length of piston 28 is formed shorter by a predetermined amount than the connecting shaft 27*d* of piston shaft 27, so as to yield a slight amount of play in the axial direction.

42 is a pump chamber. 29 is a piston presser roller rotatably mounted on an end portion of piston shaft 27. 30 is a piston return roller, which is also rotatably mounted on the end portion of the piston shaft 27.

32 is a cap lever formed with a rotation shaft 32*a*, an ink guide 32*b* and a lever guide 32*c*. And on its top portion, a cylindrical portion 32*d* inserted into a tube portion of cap as will be described is provided, with a hole for an ink flow passage formed centrally therein, and a convex spherical guide face 32*e* which is brought into contact with a spherical recess of the cap holder as will be described is formed on its front face. Further, on its side face, a partially cylindrical horizontal stop face 32*f* and a vertical stop face 32*g* which is substantially semicircular step portion are provided in a pair with opposed side face.

The ink flow passage 32*f* is formed to pass from the cylindrical portion 32*d* as previously described through the inside of the lever 32, bent at right angles midway, passing through a center of the ink guide 32*b*, and open to its end face.

33 is a lever seal into which the ink guide 32*b* is fitted and which is fitted under pressure into the cap lever carrier 24*d*. 33*a* is a communication aperture which communicates a notch 32*i* of the ink guide 32*b* with an ink flow passage 24*e*.

34 is a cap holder provided with a hook 34*a* engageable with the horizontal stop face 32*f* and the vertical stop face 32*g* of cap lever 32 on opposed positions. Also, a holder guide portion 34*b* having a spherical recess to make contact with the guide face 32*e* of cap lever 32 is formed. 34*c* is an opening portion for mounting a cap as will be described.

35 is a cap on the lower portion of which is provided a seal face 35*a*, a slit-shaped channel 35*b* (hereafter called a slit or grooved position) for collecting residual ink within the cap, and a suction port 35*c* for sucking, and on its back portion is formed a tube portion 35*d* having internal ink passage. Note that in this example, the slit 35*b* is provided substantially over the entire length of area in the upward and downward directions on a central portion in inner wall of the cap, and the suction port 35*c* is formed elliptically in the same width as the slit width. On the inner wall face provided with the slit, a taper face is formed in a portion ranging from a boundary with a side wall portion where the seal face 35*a* is provided to the slit 35*b*. However, as long as received ink can be collected well, any number of slits or any shape can be taken used. For example, the slit may be formed radially from the suction port. Also, the suction port does not need to reside within the slit.

35*e* is a flange portion which serves as a stop member when attached to the cap holder 34. The tube portion 35*d* is inserted into the cylindrical portion 32*d* of cap lever 32 as previously described. Note that if the cap 35 housed in the cap holder 34 is attached to the cap lever 32, it is communicated to the ink flow passage 32*h* of cap lever 32 via the tube portion 35*d*, wherein the cap holder 34 serves as an equalizer through the holder guide portion 34*b*, and the hook portion 34*a* engages the vertical engagement face 32*g* of cap lever 32 to serve as a stop. Note that when the cap equalizes the head discharge port formation face, the equalization can be performed smoothly with the deformation of tube portion 35*d* or the relative movement of the cap lever 32 with respect to the cylindrical portion 32*d*.

Figure 8A:
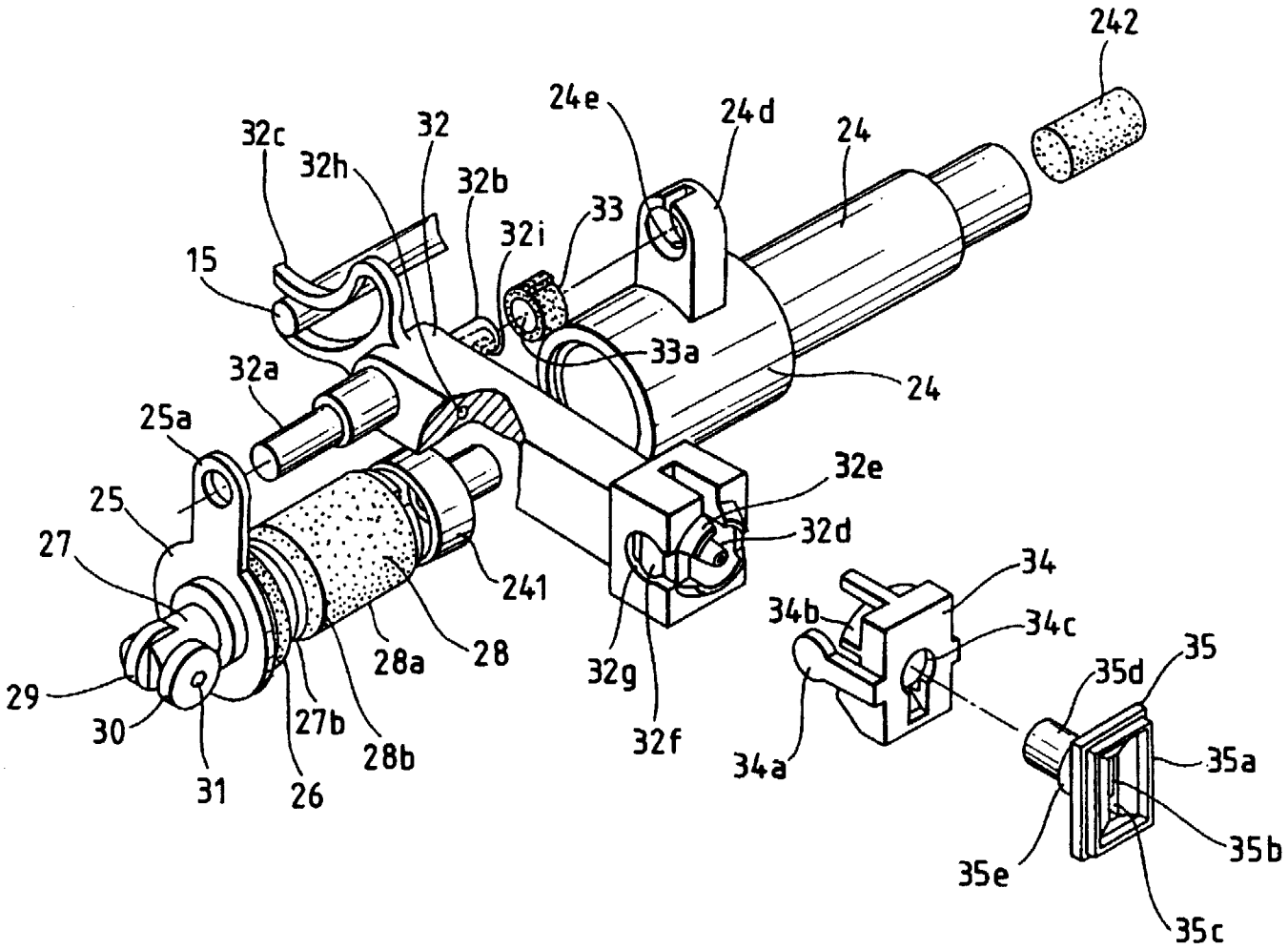
FIGS. 8A and 8B are an exploded perspective view showing one example of a recovery system for a recording head and a cross-sectional view of a cap unit and its peripheral portion, respectively.
Figure 8B:
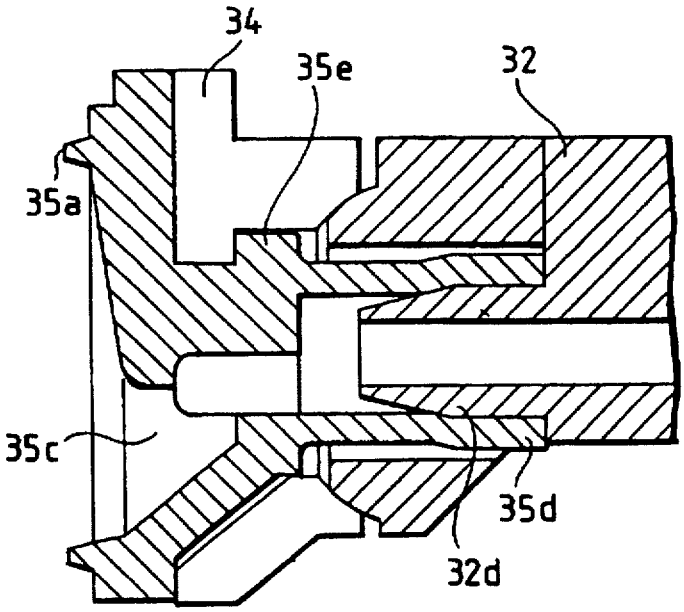
Figure 8C:
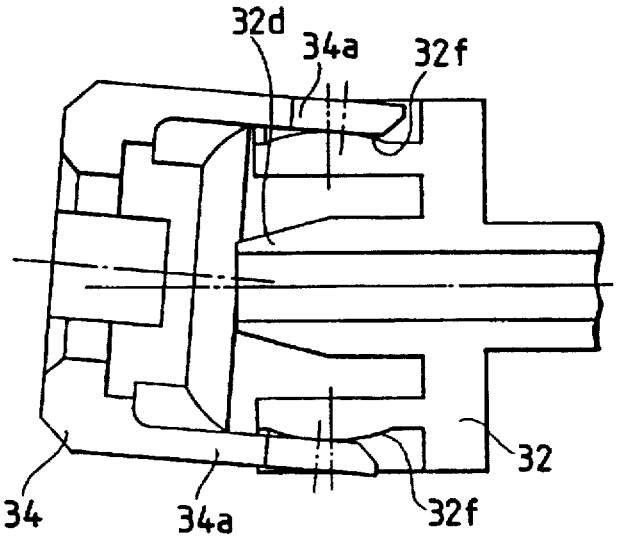
FIGS. 8C and 8D are an upper view and a side view showing the equalizing state of cap, respectively.
Figure 8D:
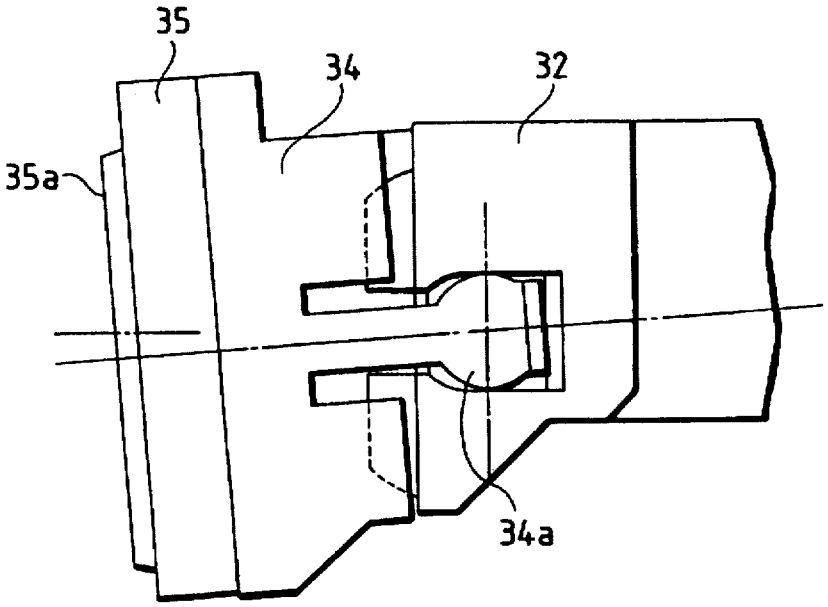

FIGS. 8C and 8D are views showing the equalization from the above and the side of cap 35.

Note that in this example, the tube portion 35*d* which is an ink communication portion of the cap has the elasticity, while the cylindrical portion 32*d* which is an ink communicating portion of the cap lever is formed of a material considered as the rigid body compared with the elasticity of the tube portion 35*d*. Accordingly, the holding accuracy of cap 35 against the head discharge port formation face, i.e., the face accuracy of cap 35 against the head discharge port formation face can be secured by the cylindrical portion 32 of cap lever, and the equalization of cap 35 against the head discharge port formation face during the capping is permitted by the deformation of the tube portion 35*d*.

On the contrary, when the communication portion of both the cap and cap lever is made of an elastic member, it is necessary to take into consideration the elasticity of the communication portion to satisfy sufficiently both the holding property and equalization, so that the selection of material is inconveniently limited by that design. On the other hand, when the cap communication portion is made of a rigid body, and the cap lever communication portion is made of an elastic material, the cap communication portion and the cap body are separate members, so that it is inconvenient to manufacture the cap as it is constructed by coupling them, and a problem may arise in respect of the holding accuracy as the lever communication portion for holding the cap and exerting the capping force on the cap has the elasticity.

Further, in this example, the holding accuracy and equalization are made more excellent in connection with the constitution of cap holder 34 and cap lever 32. This is because with a spherical recess of holder guide portion 34*b* and a convex spherical guide face 32*e* of lever 32 being in contact, when the cap 35 comes into contact with the discharge port formation face, the holder 34 and the cap 35 are displaced along a sphere, and the hook portion 34*a* of holder 34 and vertical and horizontal stop faces 32*g*, 32*f* of lever 32 permits the displacement along the sphere as above mentioned, while serving as a stop. When the stopper feature is only given to the mounting portion holder lever, it is understood that the face accuracy of cap on the discharge port face becomes improper owing to the dimensional variation or aging of the mounting portion (especially, further worsened when lubricant is applied to the above-mentioned spherical contact face in view of the equalization), and the equalization becomes incomplete, but in this example, such a disadvantage will not occur.

Referring now to FIG. 2 again, 36 is a paper feed roller for conveying a recording medium such as a paper, which is formed by applying an elastic coating (e.g., urethane or acrylic resin) on a surface of aluminum drawn tube, for example. Also, this roller 36 uses its interior as a reservoir of waste ink, and serves as the platen for restraining the record surface of the recording medium on its external face. 37 is a waste ink absorbing member provided within the roller 36, which is made by providing an absorbing material of polyester cotton or the like inside a thin tube formed of a plastic such as vinyl chloride so as to have better ink absorbency in the axial direction. Note that waste ink tube 24*g* of the cylinder 24 is inserted into the waste ink absorbing member 37 and fixed therein, because the movement of base 50 causes the recovery mechanism to move. The fibers of absorbing material are preferably liquid non-absorbing material such as a resin or metal, but may be slightly absorbent for liquid.

Here, while the paper feed roller 36 is charged with the static electricity generated by the friction with paper, to prevent the activation of circuit breaking devices, a method of grounding the paper feed roller 36 (thereafter referred to as a PF roller) via a chassis (made of metal) of the printer will be described with reference to FIGS. 23A and 23B.

Figure 23A:
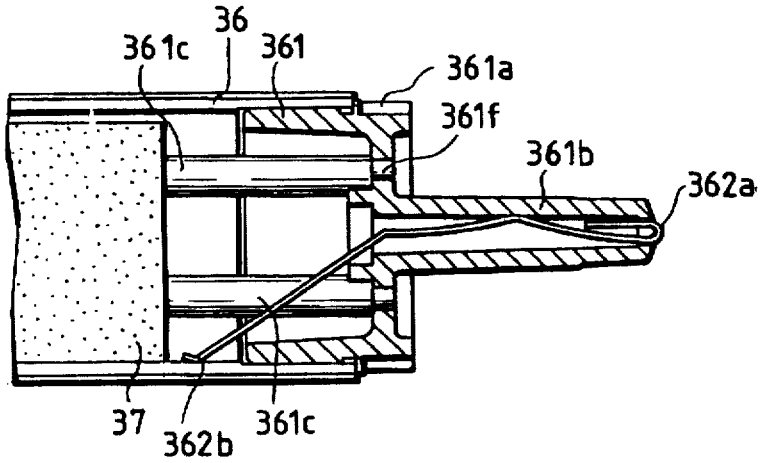
FIG. 23A and 23B are a cross-sectional view and a perspective view showing one example of a construction for grounding a paper feed roller.
Figure 23B:
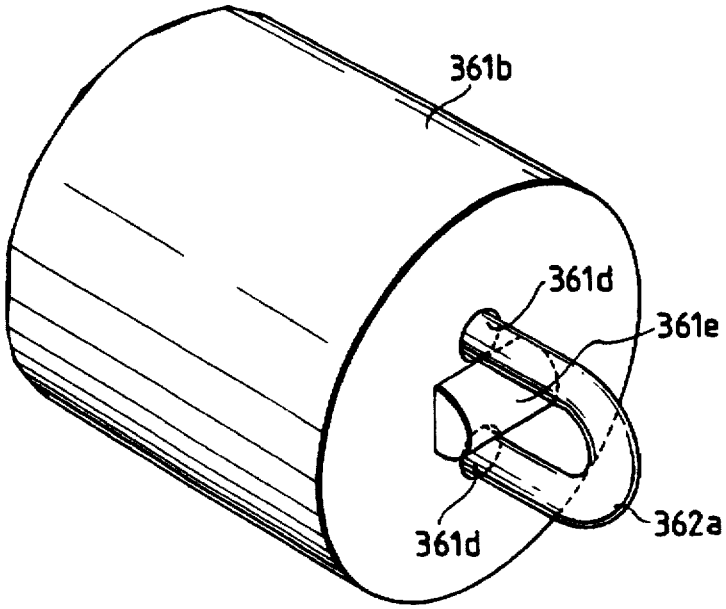

In FIGS. 23A and 23B, 361 is a PF roller cap with a gear 361*a* and a shaft 361*b* integrally formed of a plastic material, fitted under pressure into the PF roller 36 made of aluminum, and secured therein by means of caulking or adhesive. 361*c* is a stopper, wherein more than one stopper are provided on inner periphery so that waste ink absorbing member 37 will not move from a predetermined position to the PF roller cap 361, and formed integrally with the PF roller cap 361.

Moreover, the PF roller cap 361 is formed with two bores 361*d* for mounting a PF roller ground member (PF roller ground) as will be described, on an intermediate portion of which a projecting portion 361*e* is formed by projecting a predetermined amount from an end portion of shaft 361*b*. 361*f* is a hole communicating with atmosphere to promote the evaporation from the waste ink absorbing member 37. 362 is a PF roller ground formed of a metallic wire with the elasticity such as SUS, with its U-shape portion 362*a* inserted into the hole 361*d* of PF roller cap 361 as above described, in which a predetermined flexed portion is provided midway so that its tip portion comes into contact with an inner face of PF roller 36 at a predetermined pressure.

Note that the projection portion 361*e* of PF roller cap 361 is provided to fix the PF roller ground 362 at a projecting position so that a thrust pressing portion 10*b* of leaf spring 10 as previously described and the PF roller ground 362 are easily placed into contact.

38 is a paper presser plate made of a fluorocarbon resin or carbon fiber blended material, and mounted on the chassis 1 by being divided into four sections, as detailed in FIG. 3. A gear 38B is fixed at one end of shaft 38A for releasing the pressing force of paper pressing plate 38, its other end engaging a bearing 38C for supporting the shaft 38A therein. The bearing 38C is fixed to the chassis 1. Note that the gear 38B is mated with a gear portion of a release lever, not shown. 39 is a paper feed motor connected to the paper feed roller 36 via reduction gear with a predetermined gear ratio.

40*m* is a recording sheet such as a paper or film.

Next, the operation in connection with the above constitution will be described.

First, in normal recording operation, as the rotation of the shaft of carrier motor 11 causes the lead screw 2 to be rotated via the timing belt 13, the carrier 6 is moved for the scan in the printing direction along the recording sheet 40 with the lead pin 7 engaging the lead groove 2*a*. Here, as the carrier motor 11 is urged by the motor spring 14, the timing belt 13 is tensioned at all times to enable the suitable transmission.

In moving the carrier 6, though inertial force is exerted at the starting or stopping, the load applied on the motor spring 14 may be smaller because the weight of carrier motor 11 absorbs that inertial force, and thereby the load for motor rotation may be also smaller. If an air or hydraulic damper is provided in connection with this spring, noise caused by vibration of the rotor of motor 11 in starting or stopping the carrier 6 can be reduced. The overshoot of the rotor can be reduced by appropriately selecting the weights of motor and carrier, and the damping coefficient of motor spring, so that the noise can be lowered.

Next, the operation of apparatus of this example during non-recording will be described with reference to FIGS. 10–16.

Figure 10:
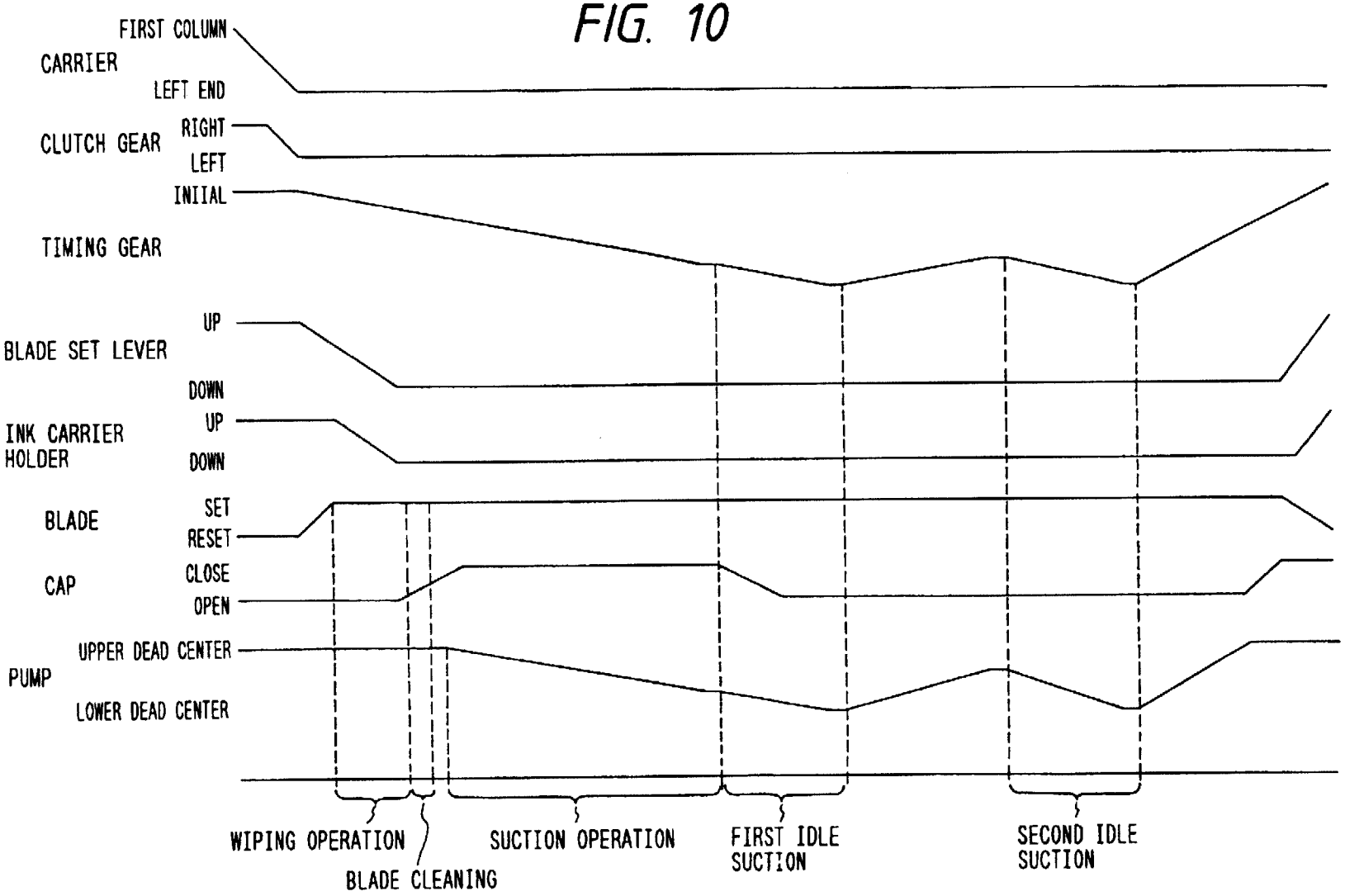
FIG. 10 is a timing chart showing the operation timing of each portion according to the present invention.

FIG. 10 is a timing chart showing the operation timing of each portion, wherein the operation timing of each portion can be determined, as shown, in accordance with the number of pulses.

Figure 11:
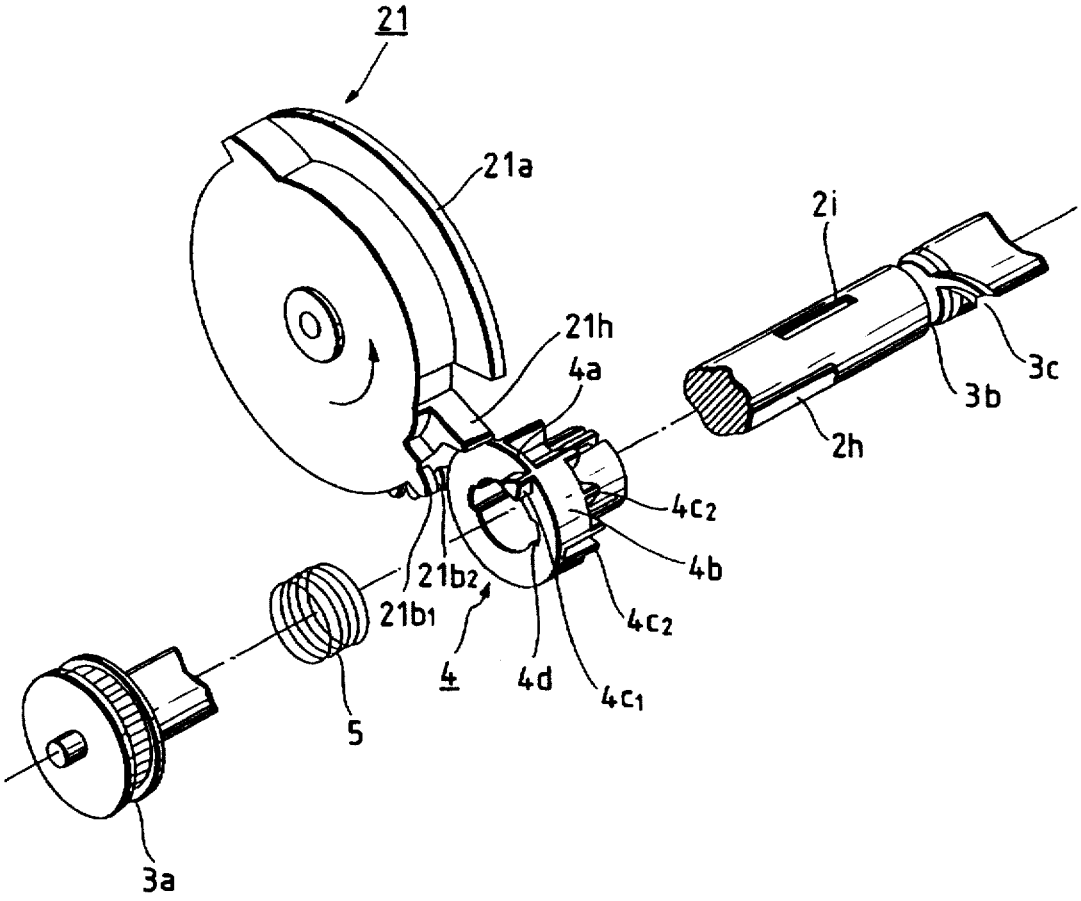
FIG. 11 is a perspective view showing one example of a clutch mechanism for transmitting driving force to a recovery system.

FIG. 11 is a perspective view showing the detailed construction of clutch gear 4 and timing gear 21 as above described, in which the clutch gear 4 can slide on the lead screw 2, and rotate together with the key groove 4*d* engaging the key portion 2*h* of lead screw 2. Also, the clutch gear 4 is urged toward the carrier 6 by the spring 5, and normally, is placed at a predetermined position by a slot 2*i* of lead screw 2 and rotated together with the lead screw 2 during recording. When the recording head 9 is moved to a home position, the clutch gear 4 is pressed by the carrier 6 correspondingly, and begins to engage the timing gear 21.

The clutch gear 4 has a start tooth $4c_1$ and a normal driving tooth $4c_2$, which are formed at different positions in the direction of width of clutch gear. The driving gear $4c_2$ is not formed over the entire periphery of gear, but partially has a curved surface 4*b*. Further, on an edge portion of clutch gear 4, a collar 4*a* is formed over the entire periphery.

The timing gear 21 has a start tooth $21_{b1}$, and two driving teeth $21b_2$, $21b_3$ at different positions, the teeth $21b_1$, $21b_2$, $21b_3$ being formed at different positions in the direction of width.

FIGS. 12A–12C and FIGS. 13A–13B are views showing the engagement state between the clutch gear 4 and the timing gear 21.

Figure 13A:
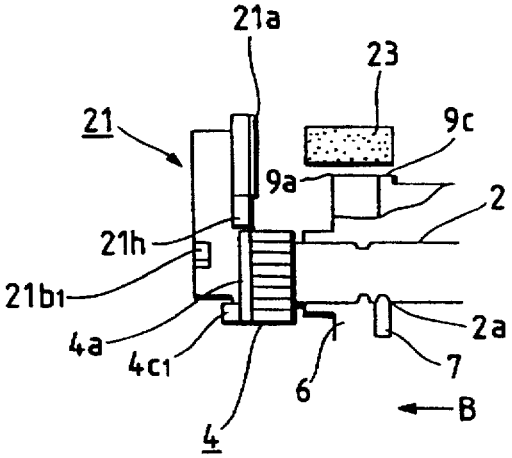
FIGS. 13A and 13B are front views similar to FIG. 12.
Figure 12A:
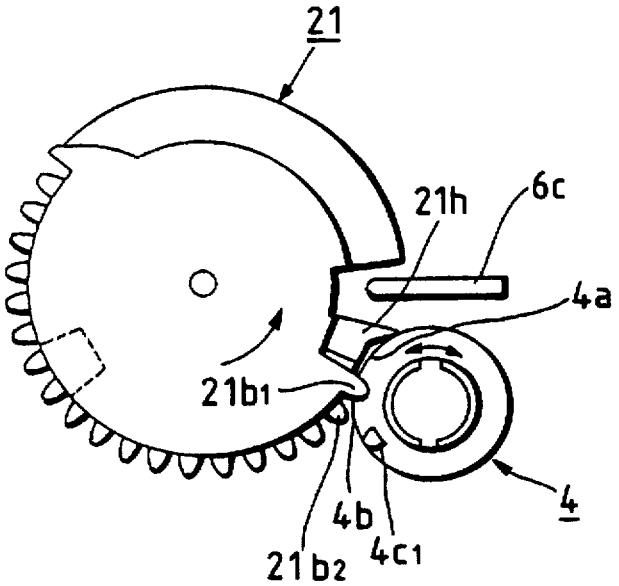
FIGS. 12A–12C are side views showing the engagement state of a clutch gear and a hook with a timing gear in the clutch mechanism as shown in FIG. 11.
Figure 12B:
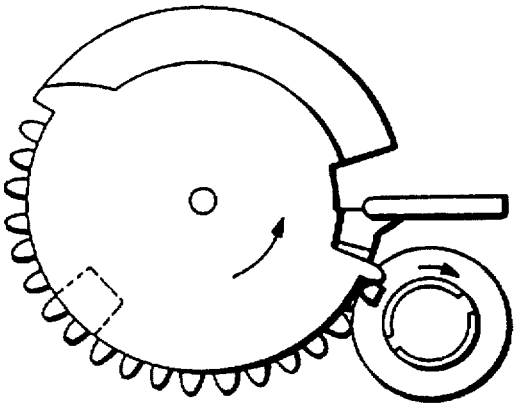

During normal recording, the engagement state is as shown in FIGS. 12A and 13A. However, in FIG. 13A, the lead pin 7 is not located at the position as shown, and the blade 17 and the ink carrier 19, not shown, are located on the upper portion of ink absorbing member 23.

At this time, the clutch gear 4 is rotated along with the rotation of lead screw 2, but is not located at a position where the start tooth $4c_1$ and the start tooth $21b_1$ are in engagement (see FIG. 13A). Thereby, the timing gear 21 is not rotated, and the driving tooth $21b_2$ at the left end of timing gear 21 and the collar $21_h$ are in the positional relation of being spaced a slight distance from the collar 4*a* of clutch gear 4 and are able to come into contact therewith, so the timing gear 21 can not be rotated in any of the directions.

Thereby, some rotational force or human power is exerted on the timing gear 21, it is not rotated inadvertently, so that errors at the operational position of the recovery mechanism can be prevented.

Figure 13B:
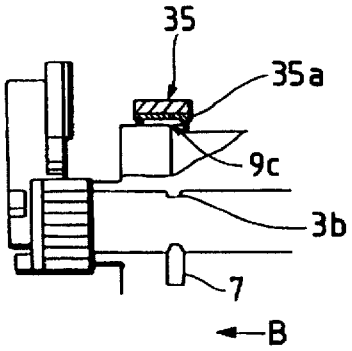

If the recording head 9 moves to the home position, and the carrier 6 presses the clutch gear 4, the positional relation between the clutch gear 4 and the timing gear 21 is finally as shown in FIG. 13B. In this process, the start teeth $4c_1$ and $21b_1$ are placed in engageable positional relation (however, the lead pin 7 has not been located at this position).

Figure 12C:
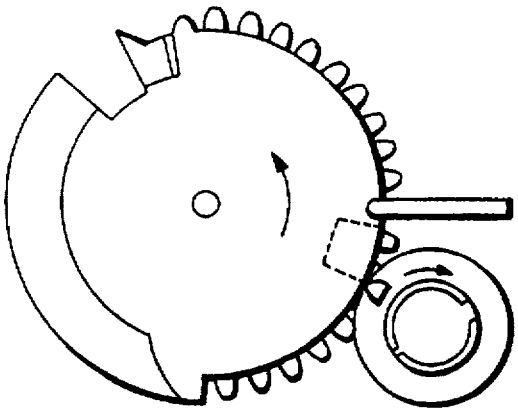

Next, when the lead pin 7 moves from groove 3*c* to groove 3*b*, the clutch gear 4 is rotated clockwise in FIG. 12, in which the positional relation sequentially changes from the state of FIG. 12A to that of FIG. 12C. Then, as the curve portion 4*b* as non-tooth portion as shown in FIG. 11 is located in closest proximity to the timing gear 21 until the start teeth $4c_1$ and $21b_1$ are placed in engagement, the timing gear does not move inadvertently to cause other driving teeth to be first engaged with each other.

Thereby, the mating between the clutch gear 4 and the timing gear 21 is always started by that between respective start teeth, so that the rotation of timing gear 21 is always started at a correct position.

Consequently, the operation of the recovery mechanism driven via the timing gear 21 is made correctly.

Also, some advantages can be obtained such that the attachment precision of clutch gear 4 and timing gear 21 are not required to be very high.

Note that the driving teeth $21b_3$ located differently among the driving teeth of timing gear 21 is one engageable when the above-mentioned curve portion 4*b* is confronted with the timing gear 21 again, as shown in FIG. 7B. That is, if the driving teeth are located at the same side as that for normal driving teeth $21b_2$, they may be brought into contact with the curve portion 4*b*, and thereby, that driving teeth are displaced for the engagement between respective driving teeth.

Also, while the timing gear is rotating with driving teeth in engagement, the hook 6*c* attached to the carrier 6 slides on the side face of timing gear 21.

Thereby, separation of the recording head 9 from the home position can be prevented, for example, by separating the lead pin 7 from the groove 3*b* before predetermined teeth are mated. This is because when the recording head 9 performs a series of recovery processes at the home position, the lead screw is rotated twice, and so the lead pin 7 may be moved to the groove 3*c*.

Note that in the previous example, a series of recovery processes are made by two revolutions of the lead screw, whereas they are not limited to such an operation, and any number of revolutions can be set, whereby the degree of freedom in designing the clutch mechanism can be decreased.

Figure 14A:
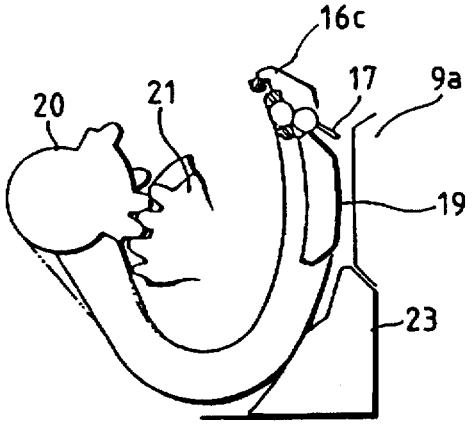
FIGS. 14A–14D are side views for explaining sequential operations of a blade and an ink carrier unit.
Figure 14B:
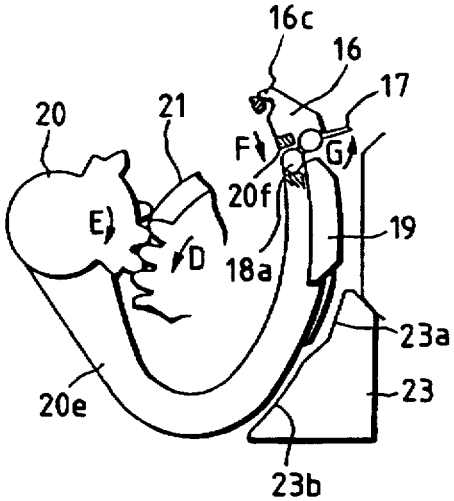
Figure 14C:
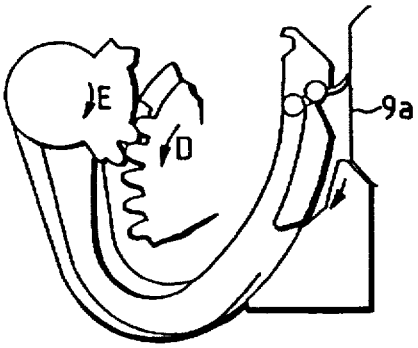
Figure 14D:
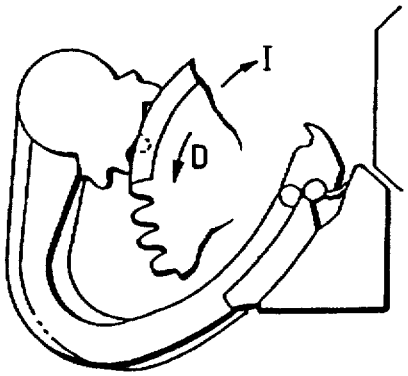
Figure 15A:
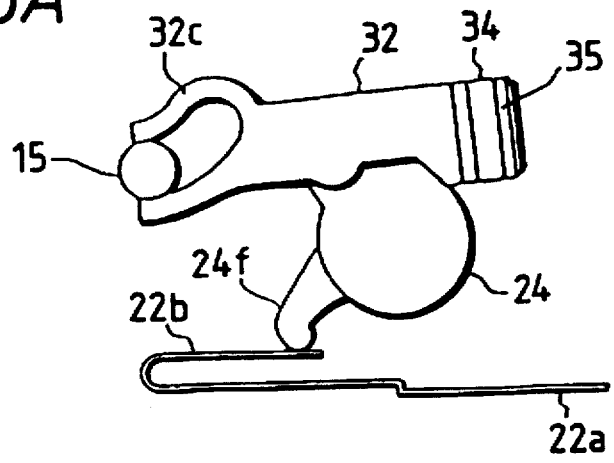
FIGS. 15A–15C are side views for explaining sequential operations of a cap unit.
Figure 15B:
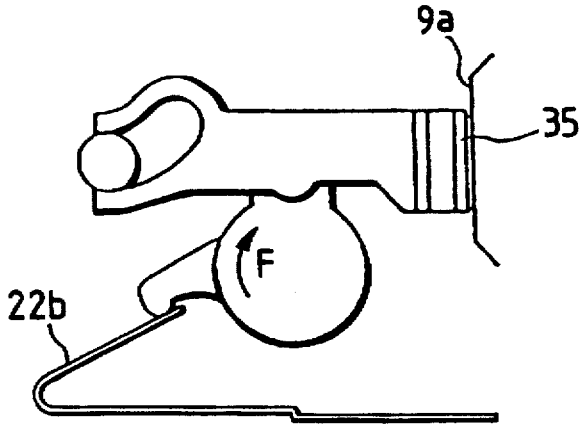
Figure 15C:
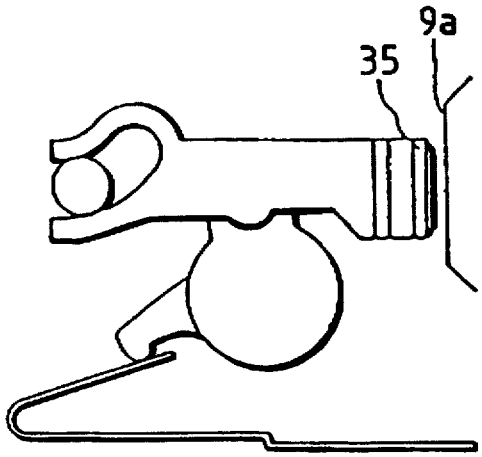
Figure 16A:
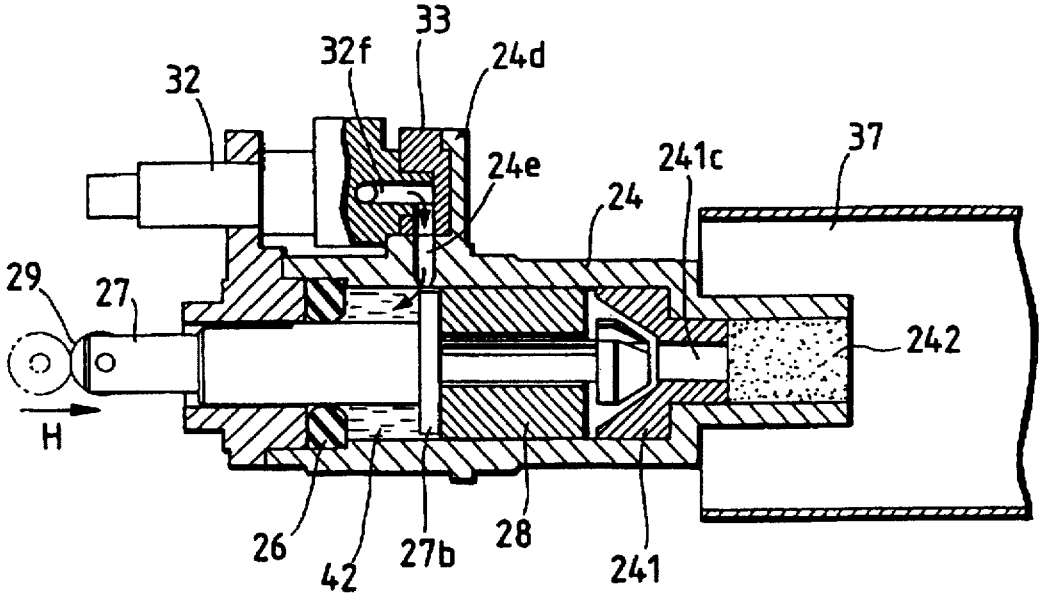
FIGS. 16A and 16B are side cross-sectional views for explaining the operation of a pump for performing the suction recovery.
Figure 16B:
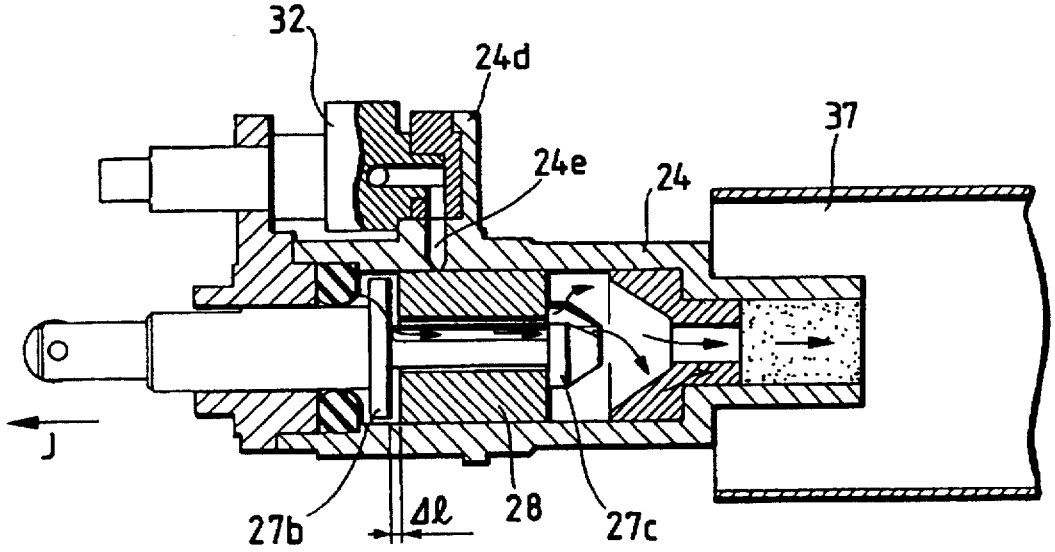

FIGS. 14A–14D are explanation views showing sequential operation states of the mechanism associated with the blade 17, FIGS. 15A–15C are explanation views showing sequential operation states of mechanism associated with the cap 35, and FIGS. 16A–16B are explanation views showing the operation of mechanism for introducing waste ink into waste ink receiver 37 within the roller 36. With reference to those figures and FIGS. 12 and 13 as above described, the operation will be described.

Firstly, the carrier 6 is moved in the direction to the home position (direction as indicated by an arrow B). At this time, as shown in FIG. 13A, the lead pin 7 still engages the lead groove 2*a*, with discharge ports 9*c* of head element 9*a* being opposed to the ink carrier 19 (see FIG. 14A). Here, the discharge operation (thereafter referred to as predischarge) is carried out by driving all the discharge energy generation elements of head element 9*a* at this position to remove some thickened ink with the discharge force, and thereby, the recovery operation with predischarge is terminated. Also, periodic precharges are performed at this position during normal recording to prevent thickened ink from around unused discharge ports. Note that FIG. 14A is a side view around the periphery of the same position.

Further, as shown in FIG. 13B, if the carrier 6 is moved in the direction of arrow B by rotating the lead screw 2, the clutch gear 4 is pressed by the presser portion 6*a*, and thus is moved in the same direction of arrow B, so that the start tooth $4c_1$ is positioned to be engageable with the start tooth $21b_1$ of timing gear 21. Then, the clutch gear 4 is rotated synchronously with the lead screw 2, the timing gear 21 is rotated in the direction of arrow D as shown in FIGS. 14B with the engagement between respective start teeth. On the other hand, as the lead pin 7 enters through the lead-in groove 3*c* into the position groove 3*b*, the rotation of lead screw 2 does not cause the carrier 6 to move.

If the timing gear 21 is rotated in the direction of arrow D, the set lever 20 is rotated in the direction of arrow E, because its gear portion and the gear portion of set lever 20 are mated. By this time, as the hook portion 16*c* of blade lever 16 engages a click portion of chassis 1, the set lever 20 only is rotated and the blade lever 16 is stopped, and in a short time, the set face 20*f* of set lever 20 is rotated in the direction of arrow F while depressing the rotation tab 18*a* of blade shaft 18, so that the blade 17 is rotated in the direction of arrow G to be set in a state of being engageable with the discharge port face.

With a further rotation of timing gear 21 in the D direction, the hook portion 16*c* of blade lever 16 is disengaged from the click portion of chassis, and the set lever 20 and the blade lever 16 are further rotated to wipe over the discharge port face of head 9 with the wiper 17. At this time, ink liquid and others removed by the wiping of blade 17 are eliminated in only one direction, i.e., only downward in this case, whereby ink liquid and others eliminated are absorbed and carried in the upper portion of ink carrier 19. Then, the ink carrier 19 comes into contact with the ink absorbing member 23. With a further rotation of the set lever 20, as the ink carrier 19 and the blade 17 slide on a wipe-over face 23*a* of ink absorbing member 23, ink received into the ink carrier 19 at the predischarge, or dust wiped from the discharge port face by the blade 17 are accepted by the wipe-over portion 23*a*, and ink droplets adhering to the discharge port face are also absorbed. Thereby, the ink absorption ability of ink carrier 19 can be retained for a long term.

If the timing gear 21 is further rotated in the direction of arrow D, the stop teeth 20*a*, 20*b* of set lever 20 and the stop cam 21*a* of timing gear 21 are made opposed and contact, so that the rotation of set lever 20 is restrained, and at the same time, the driving gear of timing gear 21 becomes an omitted tooth portion, thereby not exerting the rotation force.

As above described, since the blade and the absorbing member for carrying ink liquid or others removed from the blade are made integrally with the ink receiver at the predischarge, the apparatus can be miniaturized, and the time necessary for the recovery operation can be shortened.

With a further rotation of the timing gear 21, the cap 35 is stopped at a position away from the discharge port face of head element 9*a*, as shown in FIG. 15A, because the cap cam 21*c* of timing gear 21 first restricts the rotation shaft 32*a* of cap lever 32*c* as shown in FIG. 8. Subsequently, with a further rotation of the timing gear 21 in the direction of arrow D, as the cap cam 21*c* is disengaged from the cap cam 21*c*, thereby releasing the restrained state, the cylinder 24 is rotated in the direction F with the rotation lever 24*f* urged by the spring portion 22*b* of ink absorbing member spring 22, as shown in FIG. 15B, so that the cap portion 35a of cap 35 is firmly pressed; against the discharge port formation face, and the capping operation is terminated. Note that FIG. 13B shows an upper view at this time.

The above operations are cleaning and capping operations, and normally, the operation stops here, whereby in accordance with a next recording signal, the above operations are inversely performed to enter the recording operation.

Next, the suction recovery operation, which is performed when the discharge condition has not been sufficiently restored with the predischarge, will be described.

When this operation is activated, the timing gear 21 is further rotated from the cap position to depress the cap lever 32 with the cap cam 21*f*, so that the cap 35 is separated a little from the discharge port formation face, as shown in FIG. 15C.

If the timing gear 21 is further rotated in the direction D, the cap portion 35*a* is firmly pressed against the discharge port face as it is disengaged from the cap cam 21*f* again.

Next, the pump operation will be explained. It should be note that the entry of the recovery operation after termination of cap sealing as previously described involves entering the suction operation.

First, with a rotation of timing gear 21, as the piston set cam 21*g* presses the piston presser roller 29 mounted on the piston shaft 27, the piston shaft 27 moves in the H direction as shown in FIG. 16A. The piston 28 is also pressed by the piston presser 27*b*, thereby moving in the H direction and placing the pump chamber 42 under negative pressure.

At the ink flow passage 24*e* of cylinder 24 is being closed by the piston 28, the negative pressure of pump chamber 42 only increases, with the piston 28 being movable. On the other hand, after being capped again as previously described, the ink flow passage 24*e* opens, and the ink from the recording head 9 is cleared via the suction port 35*b* of cap 35. The ink cleared hereby passes through the ink flow passage 32*f* formed within the cap lever 32, through the communicating aperture 33*a* of lever seal 33 and further through the ink flow path 24*e* of cylinder 24 into the pump chamber 42.

Figure 24A:
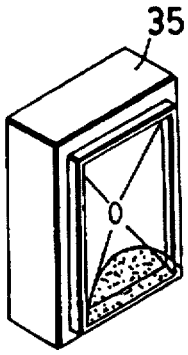
FIG. 24A PRIOR ART
FIGS. 24A and 24B are perspective views for explaining the ink residual state taking place in a cap according to a conventional a construction.
Figure 24B:
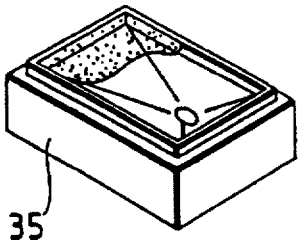
FIG. 24B PRIOR ART

At this time, conventionally, the ink sometimes remains in a lower portion of cap 35, as shown in FIG. 24A. Though it is also conceived that the suction port is biased on a lower end portion of cap, the ink may remain on the upper portion of suction port, as shown in FIG. 24B, when the printer is vertically placed.

Figure 25:
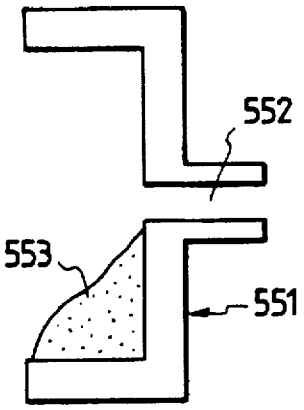
FIG. 25 PRIOR ART
FIG. 25 is a typical longitudinal cross-sectional view showing one example of another conventional head cap.
Figure 26:
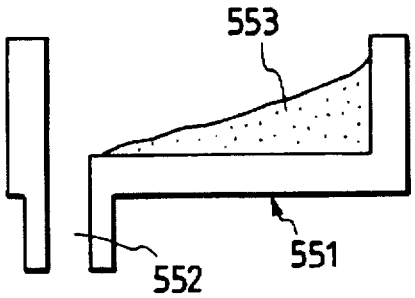
FIG. 26 PRIOR ART
FIG. 26 is a typical longitudinal cross-sectional view showing a further constitutional example of a conventional head cap.

FIG. 25 is a typical longitudinal cross-sectional view showing one example of another conventional head cap, and FIG. 26 is a typical longitudinal cross-sectional view showing a further example of a conventional head cap.

However, in a conventional head cap as shown in FIG. 25, as cap 551 is formed like a U-shape, and an ink exhaust port 552 connectable to suction pump is provided on a central portion thereof, the ink 553 within the cap at a lower level than the ink exhaust port 552 can not be cleared with the suction pump, and so remains within the cap, as shown.

As another conventional example, one constitution has been proposed in which an ink exhaust port 552 is provided on an end portion of head cap 551, as shown in FIG. 26, so that the ink does not remain within cap.

In the head cap as shown in FIG. 26, when recording head is used in a lateral orientation (horizontally), accordingly, the head cap 551 is stood from the illustrated orientation and used in the U attitude with its concave side directed laterally, the ink can be exhausted without remaining, while when recording head is used in a downward directed orientation, accordingly, it is used with the concave side of head cap 551 directed upward, as shown in FIG. 26, the ink 553 may remain within cap 551.

Figure 24C:
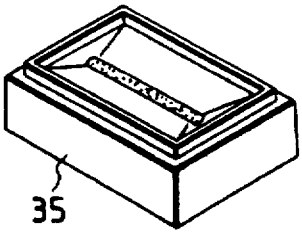
FIG. 24C is a view for explaining the effects of using a cap according to an example of the present invention.

On the contrary, in a cap of this example, as a suction port 35*c* is biased to a lower edge side and has associated therewith a slit 35*b* for collecting ink (see FIG. 8A), the ink can be collected into the slit with surface tension, and sucked through the suction port located downwardly, as shown in FIG. 24C. Accordingly, irrespective of whether the printer is used in a horizontal orientation, or vertical orientation, the performance of the cap is not degraded. Note that the thinner the width of slit 35*b*, the stronger the tensile force of ink, whereby an excellent result could be obtained with a slit 0.4–0.7 mm wide.

Figure 27:
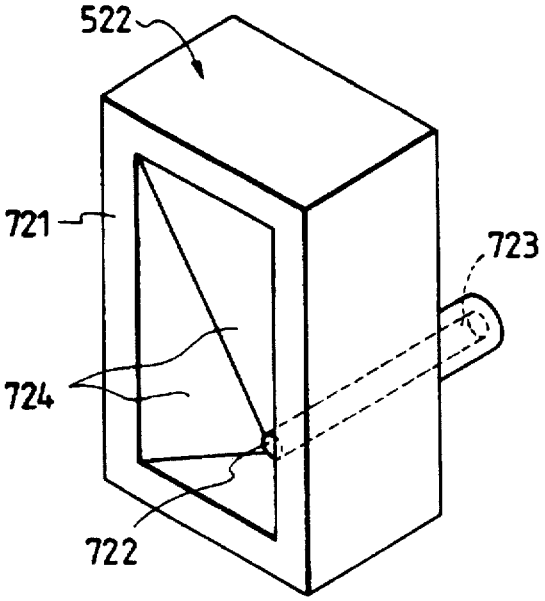
FIG. 27 is a typical perspective view showing one example of a head cap according to the present invention.
Figure 28:
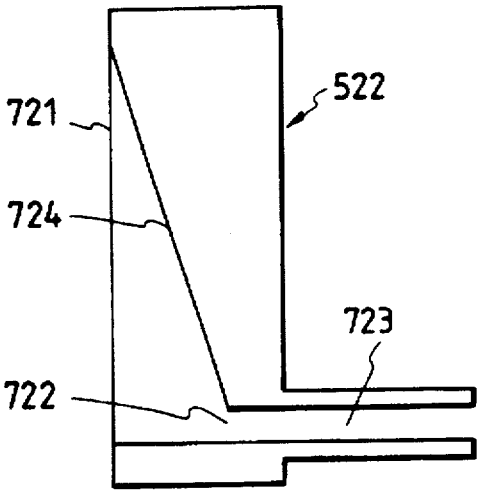
FIG. 28 is a longitudinal cross-sectional view as shown in FIG. 27.
Figure 29:
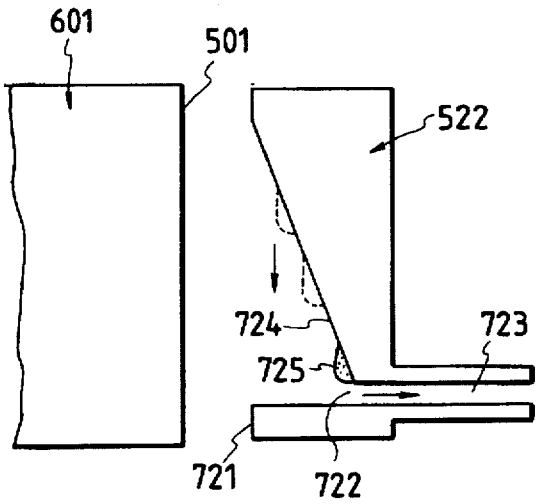
FIG. 29 is a typical longitudinal cross-sectional view showing an ink exhaust state within a head cap as shown in FIG. 27.

FIG. 27 is a perspective view from the front side of another example of a cap according to the present invention, and FIG. 28 is a longitudinal cross-sectional view of FIG. 29.

In FIGS. 27 and 28, 721 is a sealing portion which is made to contact with a discharge port face 501 of head cartridge (recording head) 601, 722 is an ink exhaust port provided on an end portion of inner plane (cavity portion) in head cap 522, and 723 is an ink exhaust passage connecting the ink exhaust port 722 to suction recovery means 515 such as a suction pump.

On the inner plane of head cap 522, the cavity portion 724 is tapered in a direction of and converging toward the ink exhaust port 722.

The above-mentioned portions 721, 722, 723 and 724 are all integrally formed.

Next, the operation of head cap 522 as shown in FIGS. 27 and 28 will be described.

First, the sealing portion 721 of cap 522 is closely affixed to the discharge port face 501 of recording head 601, so that the interior of the cap is placed in an enclosed state. Then a suction pump 515 is activated to place the interior of cap in a negative pressure state, and thereby the ink is drawn through discharge ports of recording head 601, filling the cap 522, so that the ink passes through the ink exhaust port 722 and ink exhaust passage 523 into the suction pump 515.

Next, the head cap 522 is separated from the discharge port face of recording head, wherein the cap has residual ink within its interior.

Therefore, the ink within cap 522 is cleared and exhausted by activating the suction pump 515 again.

FIG. 29 is a typical longitudinal cross-sectional view showing a state in which the pump suction for clearing ink within the head cap is being performed, with the head cap 522 separated from the discharge port face 501, after the suction recovery for the discharge port face 501 of recording head 601 is performed with the head cap 522.

FIG. 29 shows an instance where an ink jet recording head 601 is attached in a horizontal attitude, and the discharge direction of the recording head is directed horizontally, accordingly, a concave side of head cap 522 is directed horizontally.

In FIG. 29, the ink 725 within head cap 522 flows under the influence of gravity along tapered slant face (cavity portion) 724 as shown, and all ink 725 is exhausted through the ink exhaust port 722 toward the suction pump 515.

Figure 30:
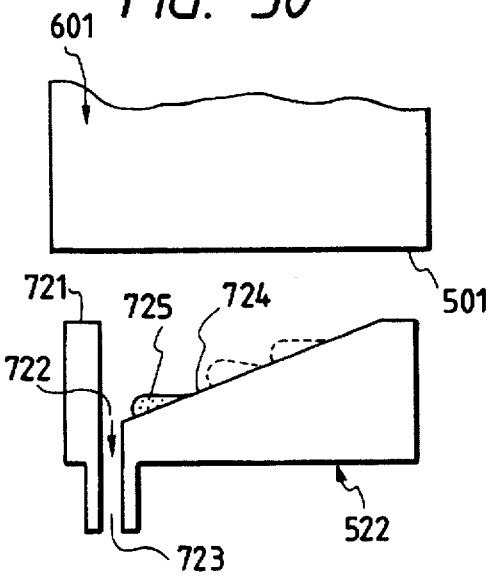
FIG. 30 is a typical longitudinal cross-sectional view corresponding to FIG. 29 when the ink is discharged downward with the orientation of the apparatus changed.

FIG. 30 shows an instance where an ink jet recording apparatus using a head cap 522 as shown in FIGS. 27–29 is placed in a vertical attitude, i.e., the discharge direction of recording head 601 is downward, and a concave side of head cap 522 is directed upward.

In FIG. 30, as an inner plane 724 of cap 522 is tapered in the direction of and converging toward an ink exhaust port 722, the ink 725 remaining within a head cap 522 flows along a slant face 724 to the ink exhaust port 722, and all ink is exhausted from the ink exhaust port 722 through an ink exhaust passage 723 into a pump 515.

Figure 31:
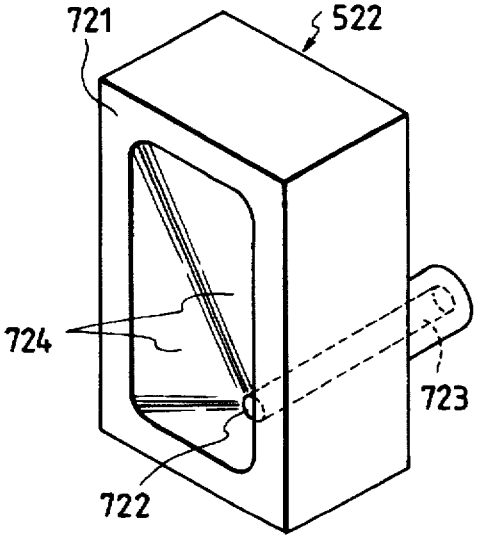
FIG. 31 is a typical perspective view showing another example of a head cap according to the present invention.

FIG. 31 is a typical perspective view showing another example of a head cap 522 according to the present invention.

In the head cap 522 as shown in FIGS. 27–30, corner portions of the cap inner plane are angled, while in this example, these corner portions are curved with a certain given roundness.

The head cap 522 of this example and the ink jet recording apparatus using that head cap are different in the above-described respect from those of the previous example, but other portions have substantially the same construction.

Generally, if any angled portion exists within the cap 522, remaining ink is liable to stay on that portion.

Thus, in the cap as shown in FIGS. 27 and 28, as corner portions within cap 522 are all curved and tapered in the direction of and converging toward the ink exhaust port 722, the ink within the cap can be passed into the ink exhaust port 722 more easily, and accordingly, all ink 725 (FIG. 29) can be exhausted through the ink exhaust port 722 into suction means 515 rapidly and securely.

Here, the operation of the timing gear 21 in the aforementioned suction recovery operation will be described again.

If the timing gear 21 is further rotated, the cap 35 is separated a little from the discharge port face by the cap cam 21*h*, and then the ink on the discharge port face and within the cap 35*a* is cleared owing to a residual negative pressure, so that remaining ink is eliminated from those portions.

Next, if the timing gear 21 is rotated reversely (in a direction as indicated by the arrow I in FIG. 14D), the piston reset cam 21i pulls the piston return roller 30, thereby moving the piston shaft 27 is a direction of arrow J as shown in FIG. 16B. At this time, since the piston 28 can move after the piston carrier 27*c* of piston shaft 27 comes into contact therewith, a clearance $_{\Delta}1$ is generated between an end face 28*h* of piston 28 and the piston presser 27*b*.

With the movement of piston shaft 27 and piston 28, waste ink sucked into the pump chamber 42 passes through the clearance $_{\Delta}1$ as described, further passing through the groove 27f of piston shaft, ink flow passage 24c of cylinder 24 and waste ink tube 24g, and is exhausted into a near central portion of waste ink absorbing member 37. Note that the ink flow passage 24e of cylinder 24 is enclosed by the piston at the early time of the operation of piston 28 and, waste ink does not flow backward toward the cap.

Note that after termination of the pump operation, the piston 28 further moves and comes not to enclose the ink flow passage 24e of cylinder wherein as the waste ink absorbing member 37 exists in the communication passage from the cap 35 to the atmosphere, the interior of cap is maintained in moist atmosphere, and no evaporation of ink occurs, so that the discharge ports and liquid channels are not dried.

The ink remaining within the cylinder 24 is collected by the piston absorbing member 241 to be passed via the flow passage absorbing member 242 to the waste ink absorbing member 37, and is thereby prevented from flowing backward toward the cap.

Figure 32A:
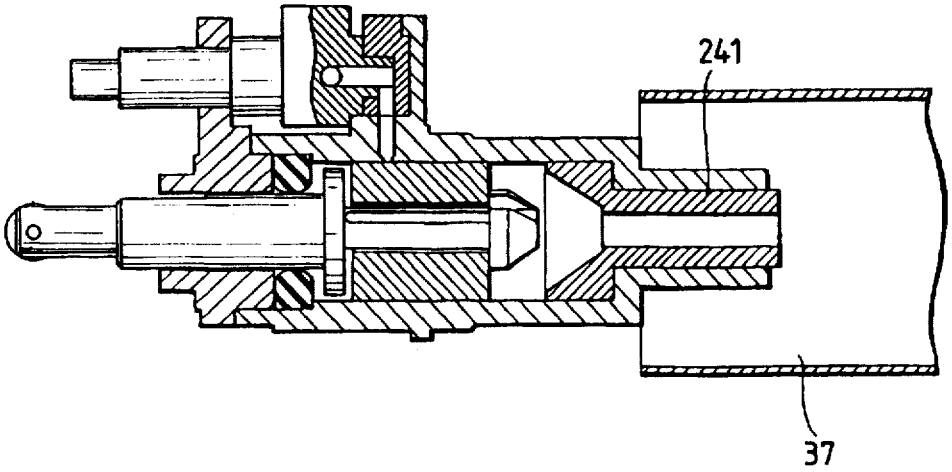
FIGS. 32A–32C are cross-sectional views showing three other examples of a pump in a suction circuit system.
Figure 32B:
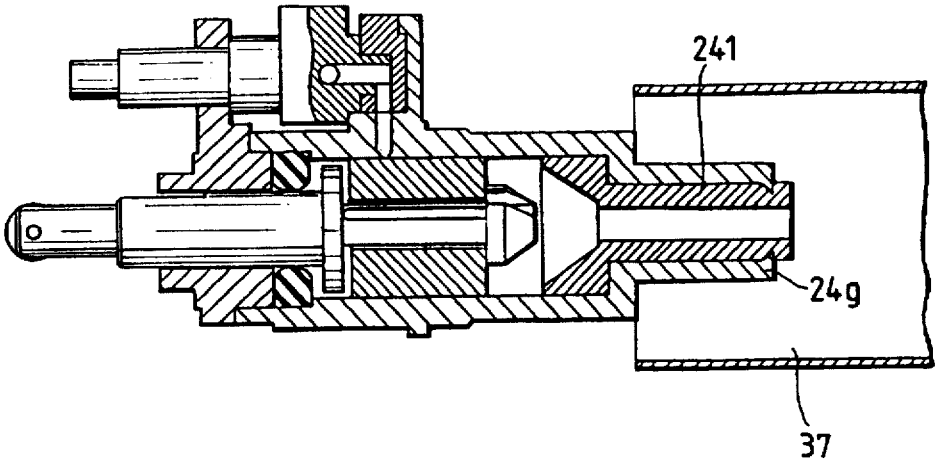
Figure 32C:
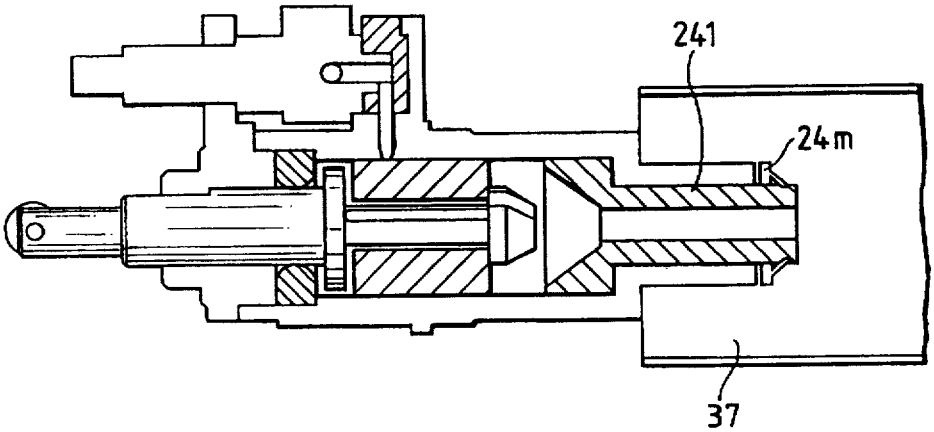

It should be noted that the constitution for preventing such back flow is not limited to that as shown in FIG. 9, but may be made as shown in FIGS. 32A–32C.

First, FIG. 32A shows a constitution in which the piston absorbing member 241 is extended to come into direct contact with the waste ink absorbing member 37, i.e., the flow passage absorbing member 242 is integrally formed.

Next, FIG. 32B shows a constitution in which an inward directed click 24g (ridge and groove)is provided on an end face of cylinder 24 to restrict the drift of piston absorbing member in the axial direction, whereby the piston absorbing member 241 is inserted, the click is snapped into place to serve as a draft stop. Also, FIG. 32C shows a constitution in which a fastener 24m consisting of more than one click provided on a thin plate formed from an elastic material for preventing the drift of piston absorbing member 241 is inserted into the piston ring afterwards and fixed therein.

FIG. 17 shows generically the sequence of predischarge and suction recovery as above described. Particularly, the figure shows the sequence in which the blade 17 waits in a wiping ready state (set state, see FIG. 14B), and after wiping, is inclined to the absorbing member 23 (reset state, see FIG. 14A), and then, set in the wiping ready state immediately before the set lever 20 returns to its original position.

Note that the recovery operation is performed once again immediately after the power is turned on, for example, when the power has not been turned on for three or more days. Also, it can be appropriately performed in accordance with the operation of start switch.

The wiping of blade is performed in a direction of discharge port array (longitudinal direction) once about every 60 seconds during printing, as well as immediately before the closing of cap and the start of printing.

The predischarge is performed such that, for example, (1) When the power is turned on. 50 times ×64 discharge ports (500 Hz)

(2) Immediately before the start of printing. 50 times ×64 discharge ports (500 Hz)

(3) During the printing. 15 times for every about 12 seconds ×64 discharge ports (500 Hz)

Note that it is assumed that the penetrating amount of blade into head is 0.7±0.3 [mm], and the penetrating amount of blade into absorbing member is 1.15±0.6 [mm]. However, in the wait state, it is preferred that the blade is placed in a free state where it is not in contact with the absorbing member.

The suction pressure minus 4 is approximately −6 [mAq] (the cap pressure welding or pressing force is above 60 [g]), and the amount of ink cleared is approximately 0.1 (+0.04, −0.025) [cc].

Next, the recording sheet conveying mechanism will be described from the recording to the paper exhaust in the apparatus of this example, with reference to FIGS. 3A and 3B.

In these figures, 38 is a paper presser plate formed of fluorocarbon resin or carbon fiber blended material as previously described, serving to exert the pressing force against a recording sheet fed thereto so that the discharge port face of recording head 9 and the recording sheet are spaced a predetermined interval. The pressing force of paper presser plate 38 relies on the elastic force of spring 38D. That mechanism is shown in detail in FIGS. 18A and 18B.

Figure 18A:
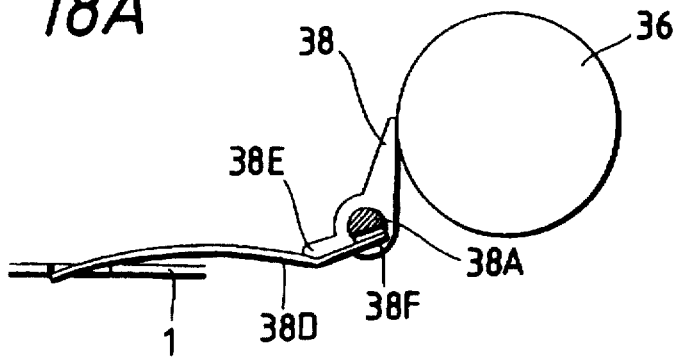
FIGS. 18A and 18B are side views showing one example of a pressing mechanism for a paper presser plate.

FIG. 18A is a view showing a state where the paper presser plate 38 exerts a pressing force against the paper feed roller. In this case, a cut-away portion of shaft 38A, which is formed with a D shape by cutting away a part of circle linearly and is slidable with the paper presser plate 38 in a rotational direction, is at a position confronted to an end portion 38F of spring plate 38D, whereby an end portion 38E of paper presser plate is urged upward in the figure by the spring plate 38D. Thereby, the paper presser plate 38 attempts to rotate in a clockwise direction around the shaft 38A, thus exerting the pressing force against the paper feed roller 36.

Figure 18B:
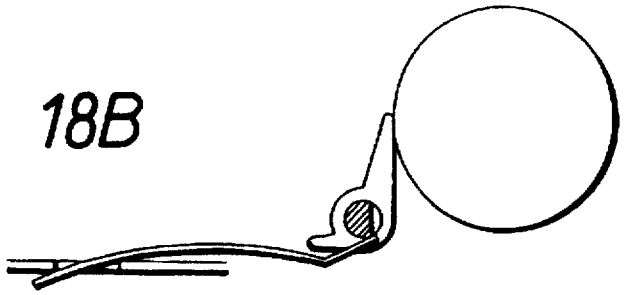

On the other hand, FIG. 18B shows a state where the action of pressing force with the paper presser plate 38 is released. In this case, the shaft 38A rotates, and a circular arc portion of shaft 38A presses on the end portion 38F. Then, the spring plate 38D is wholly depressed downward in the figure. As a result, the end portion 38E is not urged by the spring plate 38D.

In this state with the urging force released, as the shaft 38A and the paper presser plate 38 are engaged with a certain friction force, the paper presser plate 38 does not change its rotation position greatly. Thereby, even when the pressing force of paper presser plate 38 is required to release, the movement of recording head can not be prevented by the paper presser plate.

Also, the above paper presser mechanism is one in which the pressing force enough not to prevent the appropriate conveyance of recording sheet with the paper feed roller 36 in a limited space can be provided.

That is, since elastic member is not used for the paper presser plate itself, and the pressing force is generated by a leaf spring disposed along and on a bottom portion of chassis 1 which is normally a dead space, the degree of freedom for setting the pressing force with the adjustment of length of leaf spring is increased, and the paper presser member can be miniaturized.

Note that the leaf spring 38D is attached to the chassis 1 by a securing member, not shown.

Referring to FIGS. 3A and 3B again, 60 is a paper exhaust roller for exhausting recording sheet that has been recorded, and 61 is a spur for giving the pressing force to recording sheet to be conveyed by the paper exhaust roller 60, restraining the exhausting direction of the recording sheet, and generating the conveying force.

62 is a transmission roller for transmitting the rotation of paper feed roller 36 to the paper exhaust roller 60, and which is disposed in an intermediate portion between the paper exhaust roller 60 and the paper feed roller 36. The transmission of rotation is performed with the friction force between both rollers placed in contact. The paper exhaust roller 60 is of a cylindrical shape having different radii on both end portions and its intermediate portion, wherein the transmission roller 62 is made in placed contact with the intermediate portion of paper exhaust roller 60 with smaller radius. Accordingly, both end portions with larger radius are rotated at slightly higher peripheral speed than that of paper feed roller 36. Consequently, during discharge, a recording sheet is pulled slightly and conveyed, so that the record face is excellently shaped.

Note that the rotation shafts of transmission roller 62 and spur 61 are formed using coil springs with appropriate elastic coefficients, respectively. The mechanism will be detailed with reference to FIG. 19, and using an instance of spur 61.

Figure 19:
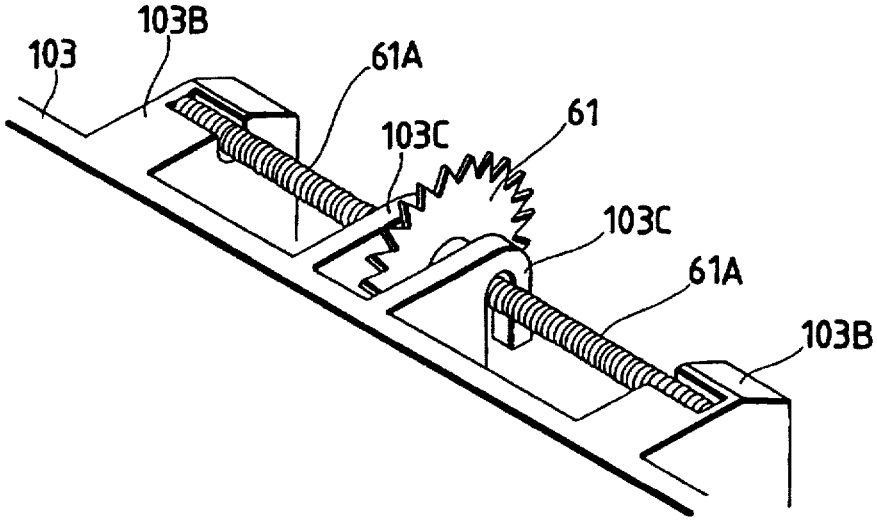
FIG. 19 is a perspective view showing one example of a supporting mounting for spur in a paper exhaust system.

In FIG. 19, 61A is a shaft formed of a coil spring, which extends through a central portion of spur 61 to both sides thereof and rotatably engages the spur 61. 103B is a shaft support member in which both end portions of rotation shaft 61A are supported, and which is formed as a part of inner cover 103 as shown in FIG. 1. The shaft support member 103B supports the shaft 61A slidably in the axial direction. 103C is restraint member for restraining the movement of spur 61 in a rotational axis direction and a direction perpendicular thereto and provided on both sides of spur 61. The restraint member 103C is formed as a part of inner cover 103, like the shaft support member 103B.

With the above constitution, the shaft 61A can obtain the pressing force of spur 61 against the paper exhaust roller 60 with its bending elastic force, as well as supporting the spur 61.

The inner cover 103 has a spring member 103A on its rear end portion, as shown in FIG. 3A, which receives the pressing force in a direction toward the paper exhaust roller owing to the reaction against a case 101. The interaction between this pressing force and the elastic force of rotation shaft 61A allows the spur 61 to exert an appropriate pressing force on the paper exhaust roller 60.

Also, by the inner cover 103 receiving the pressing force as above indicated, the engagement between the securing member 103D of inner cover 103 and the rotation shaft 60C of paper exhaust roller 60 is made more secure, as shown in FIG. 3A. As a result, the positional relation between the spur 61 and the paper exhaust roller 60 can be always maintained constant, or otherwise, can be maintained in high precision by securing in abutment with a member for stopping the rotation shaft 60C, irrespective of the precision of inner cover.

Also, in the transmission roller 62, the feature of rotation shaft 62A consisting of a coil spring is the same, wherein the abutting force onto the paper feed roller 36 and the paper exhaust roller 60 is obtained with the elastic force of shaft 62A.

The paper exhaust roller 60 is of a shape with the radius of its intermediate portion being smaller than the radii of both end portions, as previously described. The detail of this constitution is shown in FIG. 20.

Figure 20:
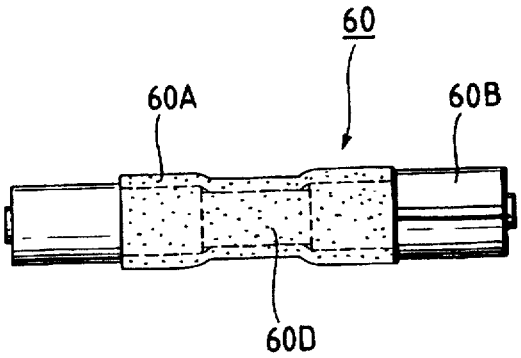
FIG. 20 is a front view showing one example of a paper discharge roller.

In FIG. 20, 60A is a cover member made of a rubber material, and 60D is a core member with the radius of intermediate portion being made smaller than the radii of both end portions. The paper exhaust roller 60 is formed by covering the cover member 60A of pipe shape onto the core member 60D.

As a result, the paper exhaust roller can be obtained comparatively easily and inexpensively without integrally forming such a shape with rubber material.

Note that a groove 60B provided continuously on one end portion of paper exhaust roller 60 serves to stop a terminal portion of recording sheet exhausted by the paper exhaust roller 60, whereby the exhaust of the recording sheet can be made more secure, even when recording sheet is deviated out of place.

Note that the shape of core member 60D is not limited to the above-described one, but may be such a shape in which the groove portion 60B is extended in original shape with intermediate portion made smaller, whereby the cylindrical shape can be obtained by covering a rubber member thereon.

Next, the vertical service of an ink jet recording apparatus of this example will be described with reference to FIGS. 21 and 22.

The vertical service condition of apparatus is used in cases where an automatic feeder 200 is used, and a thick paper such as an envelope is fed through a paper feed opening on the back side of apparatus, as shown in those figures.

When the automatic feeder is used with normal recording sheets, an upper cover 102 can be used as a stacker for recording sheets exhausted. In this case, the upper cover 102 is fixed at a different angle from that when it is used as a paper guide for feeding paper.

The condition where the upper cover 102 is used as stacker is as follows.

A position where an exhausted recording sheet itself, which is conveyed in the air with its nervy characteristic, will come into contact with the upper cover 102 or recording sheet already stacked is set near an upper edge portion 102A of the upper cover 102. Thereby, the portion where a exhausted recording sheet may slide on a recording sheet previously stacked is limited to only a leading portion of recording sheet, so that the sliding can be avoided to the utmost, and staining of recording sheets due to wet ink can be prevented.

Such a constitution requires that the upper end portion 102A is located near a common tangential line for the paper feed roller 36 and the paper exhaust roller 60, in a direction for exhausting sheet, and the lower end portion 102B is lowered.

Further, it is constituted that when a trailing end portion of recording sheet which is stopped at the upper end portion 102A is completely exhausted, it descends at the same position and is stacked without sliding.

With such constitution the length of upper cover 102 in the direction for exhausting a sheet (the length from upper end 102A to lower end 102B) is essential, wherein when recording sheet ordinarily used is exhausted almost horizontally like this example, its length is 60%–90% the length of recording sheet, and more preferably, 70%–80%.

Note that when the paper exhaust direction is different from the above-described one with different constitution or service condition of recording apparatus, the length of the stacker should be determined, taking into consideration the first factor as above described.

Figure 21:
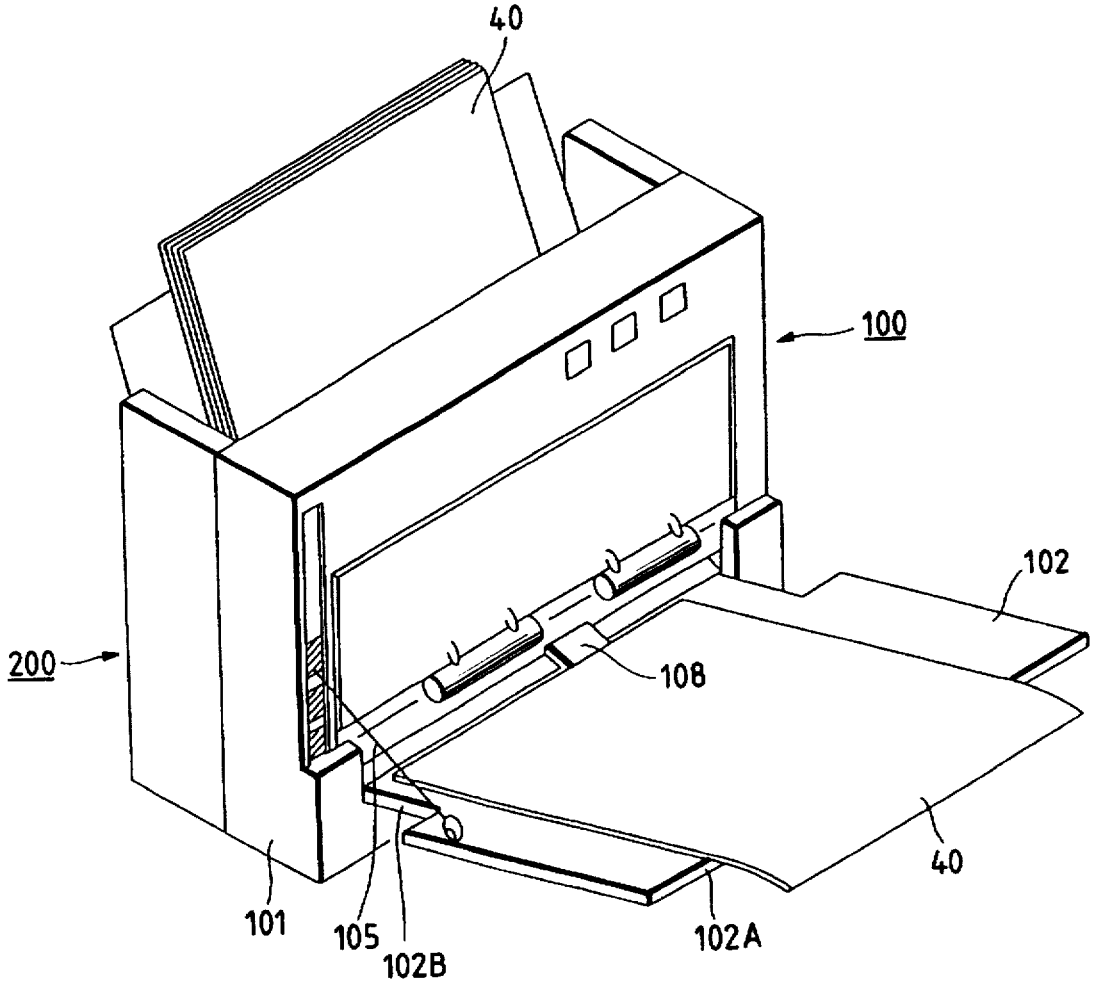
FIG. 21 is a perspective view showing another embodiment of the service condition for the apparatus according to the example of the present invention.
Figure 22:
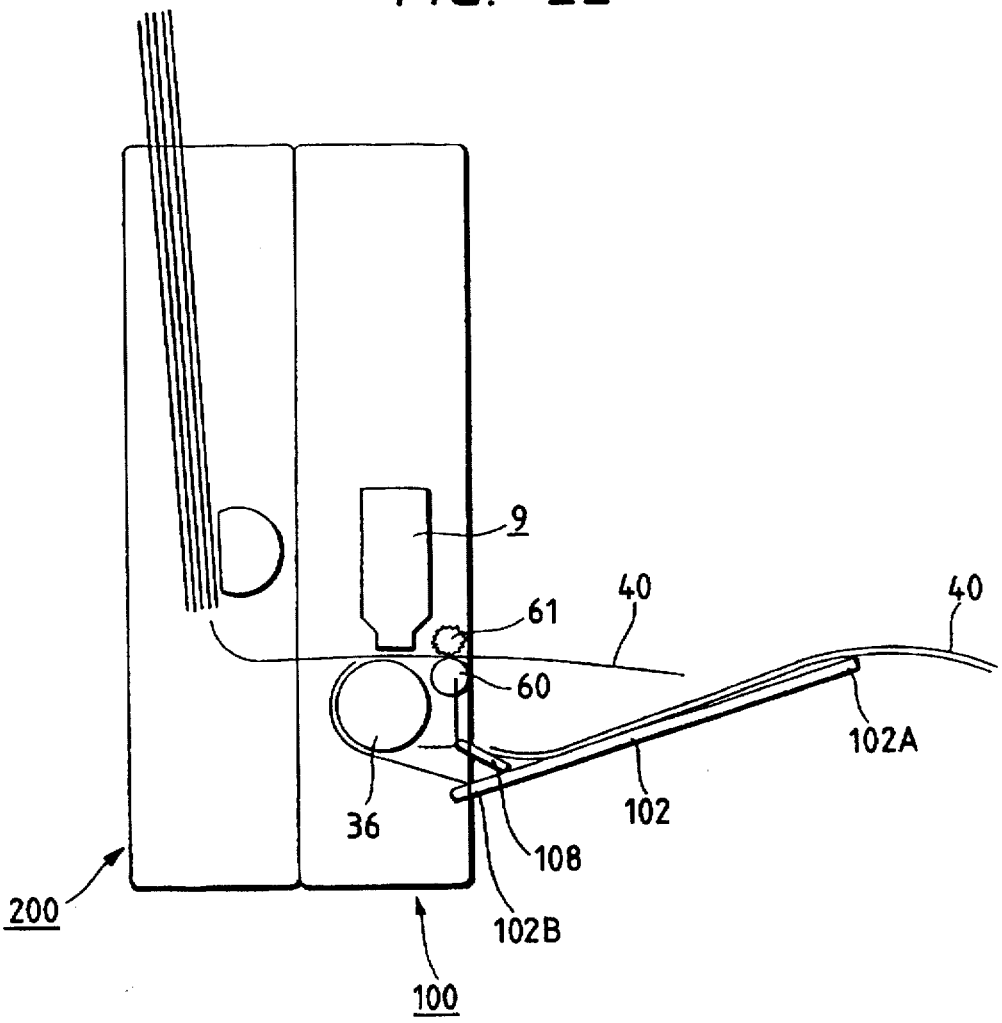
FIG. 22 is a side cross-sectional view of the state as shown in FIG. 21.

108 as shown in FIGS. 21 and 22 is an entrainment prevention piece for preventing recording sheet to be stacked from entering into the paper feed opening.

Moreover, another example of an ink jet recording apparatus to which this example is preferably applied will be described.

Figure 33:
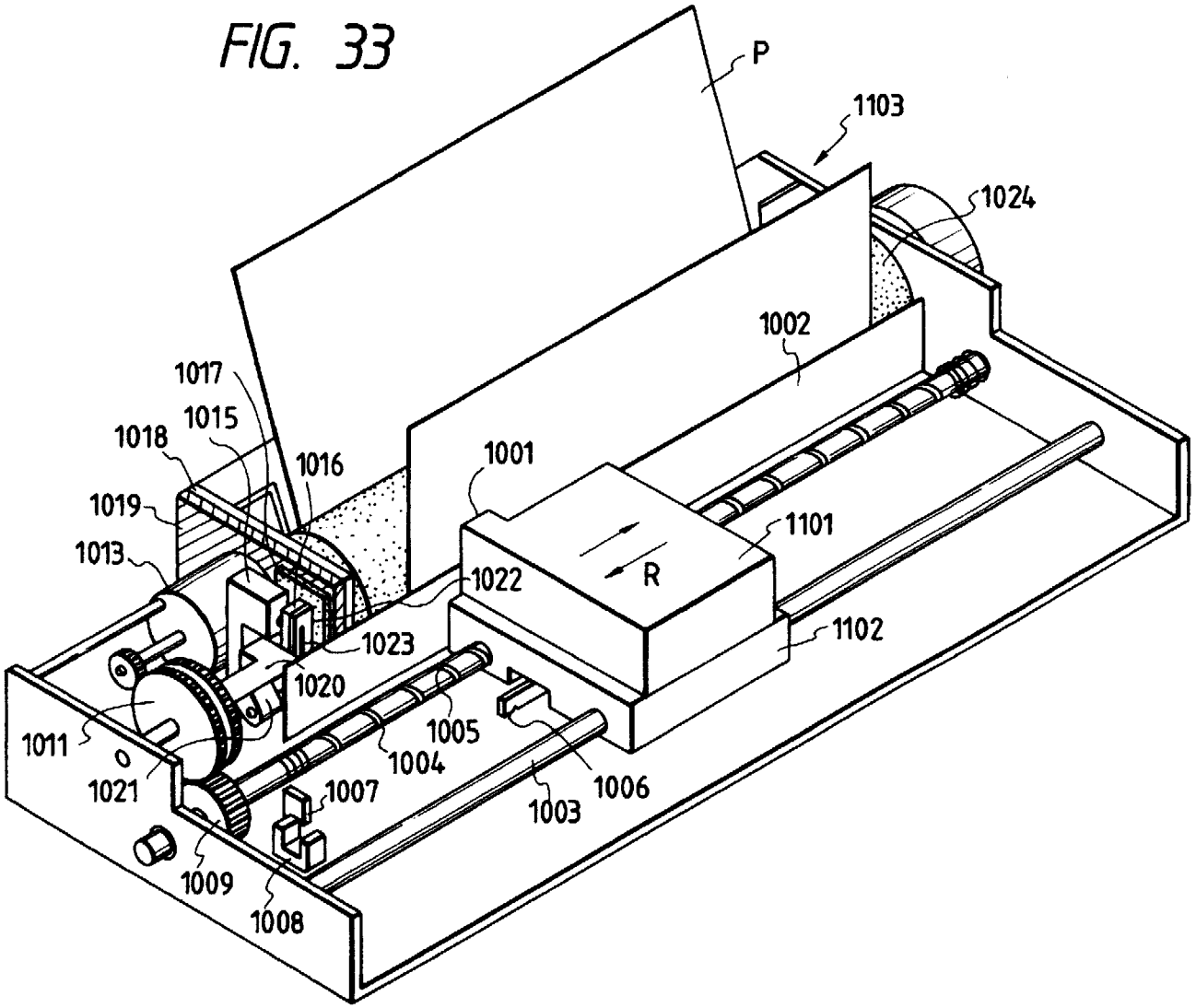
FIG. 33 is a typical perspective view showing another example of an ink jet recording apparatus according to the present invention.

In FIG. 33, a head cartridge 1101 is mounted on a carriage 1102 reciprocating along a recording medium (sheet-like recording medium such as a paper or plastic thin plate) P.

The head cartridge 1101 has a recording head (ink jet recording head) and an ink tank integrally formed, wherein a discharge port face 1001 having formed discharge ports is provided on an opposed face to the recording medium P.

The recording head 1101 is an ink jet recording head for discharging ink by the use of heat energy, comprising electrothermal converters for generating the heat energy.

Also, the ink jet recording head 1101 performs the recording by discharging the ink through discharge ports by growth of bubbles due to film boiling caused by the heat energy applied by the electrothermal converters.

A lead screw 1005 constituting a guide shaft of carriage 1102 is driven and rotated via transmission gears 1011, 1009 for driving force in accordance with the positive or reverse rotation of driving motor 1013.

The carriage 1102 engaged with a spiral groove 1004 of the lead screw 1005 is driven for reciprocating motion in the direction of the arrow P or R in accordance with the rotation of the lead screw 1005.

The recording medium P is pressed against a platen 1024 disposed along the moving direction of carriage.

On a left end portion of the recording apparatus, photo coupler 1007, 1008 as home position detection means are installed, and are constituted to sense the existence of a lever 106 of the carriage when the carriage 1102 reaches a home position at the left end, and then switch the rotation direction of driving motor 1013.

Between a recording area (substantially an area of platen 1024) and the home position, a head cap 1022 for capping the discharge port face of recording head 1101 is provided.

The head cap 1022 is supported by a cap holder 1016.

The interior of head cap 1022 is connected via an opening 1023 to suction means 1015 such as a suction pump, in which the-suction recovery of recording head (head cartridge) is performed by activating suction means 1015 with the discharge port face 1001 being capped.

Between the head cap 1022 and the platen 1024, a cleaning blade 1017 for wiping the discharge port face of recording head 1101 is disposed.

The cleaning blade 1017 is carried by a holder 1019 movable in the forward and backward directions, and the holder 1019 is attached to a support member 1018 movable in the forward and backward directions.

Note that the cleaning member 1017 can various well-known various forms, besides the form shown.

Numeral 1020 is a cam for switching the driving force of the driving motor 1013 with a clutch, wherein when the carriage 1102 reaches the home position, the carriage engages and moves the 5 cam 1020, thereby moving the lever 1021 for starting the suction for the suction recovery, so that the state in which the suction recovery operation can be performed for the discharge ports of recording head at the home position is set.

Capping means 1022, cleaning means 1017, and suction recovery means 1015 as above described are constituted to perform desired processings at a desired timing at their corresponding positions, with the action of lead screw 1005, when the carriage 1102 reaches the home position area.

Figure 34:
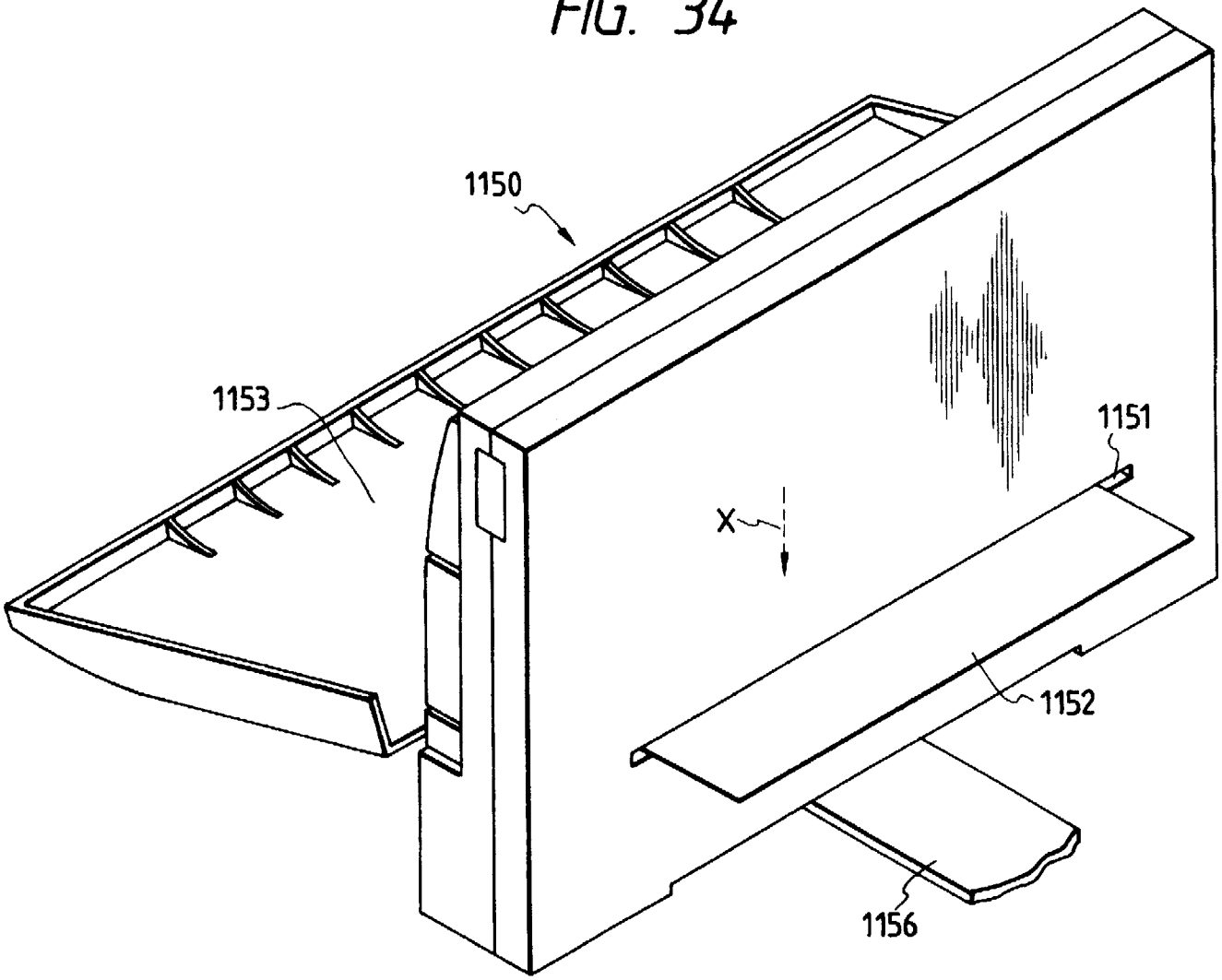
FIG. 34 is an external perspective view showing a vertical service condition of the ink jet recording as shown in FIG. 25.
Figure 35:
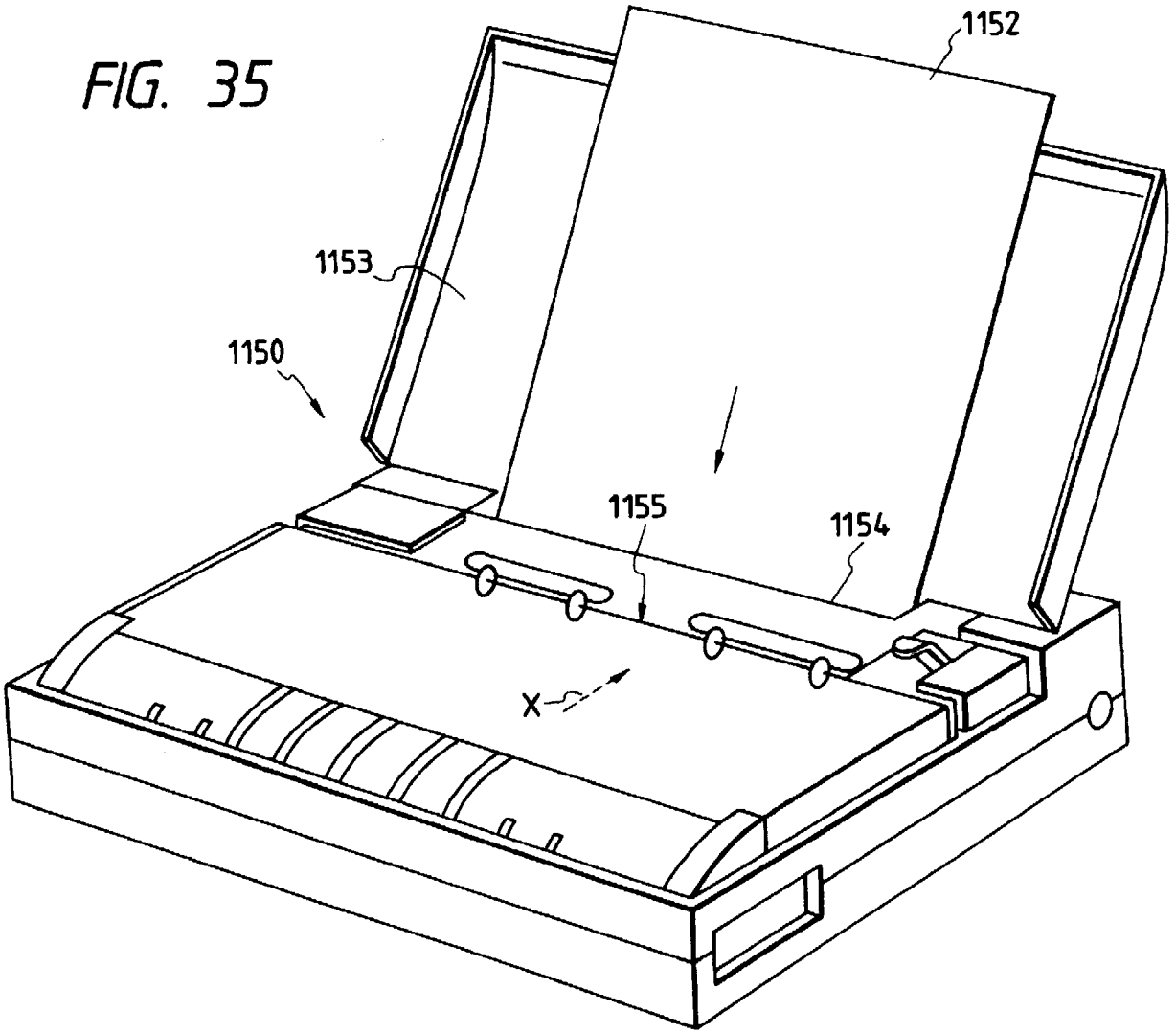
FIG. 35 is an external perspective view showing a horizontal service condition of the ink jet recording apparatus as shown in FIG. 34.

FIGS. 34 and 35 are external perspective views showing an ink jet recording apparatus comprising a head cap according to the present invention, which can record in two forms of vertical and horizontal conditions.

In the vertical condition as shown in FIG. 34, a main body is supported by a support saddle 156, wherein as the ink from the recording head is discharged downward as indicated by the arrow X, the head cap 1022 placed in opposed relation to the recording head is attached with its concave portion directed upward, as shown in FIG. 30.

Note that in FIG. 34, 1151 is an insertion opening for the recording medium (e.g., paper) 1152 when used in the vertical condition, the recording medium conveying passage within apparatus is formed almost horizontally.

Thus, an ink jet recording apparatus can be obtained in which it is capable of recording in both vertical and horizontal conditions and comprises a head cap 1022 having tapered surfaces for guiding ink to ink exhaust port 1222 within cap 1222 easily and securely.

The present invention brings about excellent effects particularly in an ink jet recording apparatus having an ink jet recording head of the ink jet system for recording by forming fine liquid droplets with the heat energy among the various ink jet recording systems.

As to its representative constitution and principle, for example, one practiced by use of the basic principle disclosed in, for example, U.S. Pat. No. 4,723,129 and 4,740,796 is preferred. This system is applicable to either of the so-called on-demand type and or the continuous type. Particularly, the case of the on-demand type is effective because, by applying at least one driving signal which gives rapid temperature elevation exceeding mucleate boiling corresponding to the recording information on electrothermal converters arranged corresponding to the sheets or liquid channels holding a liquid (ink), heat energy is generated at the electrothermal converters to effect film boiling at the heat acting surface of the recording head, and consequently the bubbles within the liquid (ink) can be formed corresponding one by one to the driving signals. By discharging the liquid (ink) though an opening for discharging by growth and shrinkage of the bubble, at least one droplet is formed. By making the driving signals into pulse shapes, growth and shrinkage of the bubble can be effected instantly and adequately to accomplish more preferably discharging of the liquid (ink) particularly excellent in response characteristic.

As the driving signals of such pulse shape, those as disclosed in U.S. Pat. No. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination of the discharging orifice, liquid channel, and electrothermal converter (linear liquid channel or right-angled liquid channel) as disclosed in the above-mentioned respective references, the constitution by use of U.S. Pat. No. 4,558,333, or 4,459,600 disclosing the constitution having the heat acting portion arranged in the flexed region is also included in the present invention.

In addition, the present invention can be also effectively made the constitution as disclosed in Japanese Laid-Open Patent Application No. 59-123670 which discloses the constitution using a slit common to a plurality of electrothermal converters as the discharging portion of the electricity-heat converter or Japanese Laid-Open patent Application No. 59-138461 which discloses the constitution having the opening for absorbing a pressure wave of heat energy correspondent to the discharging portion.

Further, as the recording head of the full line type having a length corresponding to the maximum width of a recording medium which can be recorded by the recording device, either the constitution which satisfies its length by a combination of a plurality of recording heads as disclosed in the above-mentioned specifications or the constitution as one recording head integrally formed may be used, and the present invention can exhibit the effects as described above further effectively.

In addition, the present invention is effective for a recording head of the freely exchangeable chip type which enables electrical connection to the main device or supply of ink from the main device by being mounted on the main device, or a recording head of the cartridge type having an ink tank integrally provided on the recording head itself.

Also, addition of a restoration means for the recording head, a preliminary auxiliary means, etc. provided as the constitution of the recording device of the present invention is preferable, because the effect of the present invention can be further stabilized. Specific examples of these may include, for recording head, capping means, cleaning means, pressurization or suction means, electrothermal converters or another type of heating elements, or preliminary heating means according to a combination of these, and it is also effective for performing stable recording to perform preliminary mode which performs discharging separate from recording.

Further, as the recording mode of the recording device, the present invention is extremely effective for not only the recording mode only of a primary color such as black etc., but also a device equipped with at least one of plural different colors or full color by color mixing, whether the recording head may be either integrally constituted or combined in plural number.

Further, a recording apparatus according to the present invention is provided integrally or separately as an image output terminal for the information processing equipment such as a word processor or computer, a copying machine in combination with reader, or a facsimile terminal equipment having transmission and reception features.

As clearly seen from the above description, according to the present invention, a suction recovery device capable of clearing waste ink smoothly and a reliable ink jet recording apparatus using that device can be obtained.

According to the present invention, by comprising a cap made of an elastic member formed integrally with an ink communication member having formed suction passage, and connecting a rigid ink communication member of main body of suction system to the elastic ink communication member of cap, high face accuracy for the discharge port formation face of recording head in the non-capping state can be retained, and the equalization of cap for the discharge port formation face in the capping state can be achieved excellently.

According to the present invention, as a channel portion for guiding ink is provided in connection with a suction port on the inner wall of cap, the ink received in the discharge recovery operation can be efficiently conducted into the suction port and exhausted therefrom, so that ink remaining within cap can be eliminated. Further, in whatever attitude the cap or apparatus is used, the exhaust can be performed excellently.

According to the present invention, it is possible to concentrate the suction force when suction recovery means is operated, and to achieve an excellent recording performance in any form of vertical and horizontal conditions as the ink is sucked and received in any attitude with above constitution.

What is claimed is:

1. A cap member for a suction recovery device with a suction system of an ink jet recording apparatus, comprising:

a cap contactable with or separable from a face formed with a discharge port for discharging ink to record, said cap communicating with the suction system for performing a suction recovery through said discharge port and through said cap, said cap having a groove provided in an inner surface of said cap opposed to said face so as to collect ink within said cap, a tapered surface continuing from said groove to narrow a space within said cap toward said groove and a communication port opening at a portion of an inner surface of said groove to communicate said groove with said suction recovery device, wherein said groove guides the collected ink to said communication port.

2. A cap member according to claim 1, wherein a width of said groove portion is not less than 0.4 mm and is not greater than 0.7 mm.

3. A cap member according to claim 1, wherein said suction system has a cylinder and a piston reciprocating within said cylinder.

4. A cap member according to claim 1, wherein said groove is provided on said inner surface of said cap recessed from a contact surface of said cap placed into contact with said face, and said inner surface extending from said contact surface to said groove is formed as a continuously tapered face.

5. A cap member according to claim 1, wherein said inner surface of said cap is formed with a tapered cavity which tapers toward said communication port.

6. A cap member according to claim 1, further comprising:

a cap holder for holding said cap, said cap holder having a concave spherical portion for equalizing a contact of said cap with respect to said face and a pair of stop portions provided on an outer confronted face portion of said cap holder, each of said stop portions having an end portion with a disk-like portion thereon; and a cap lever for allowing said cap to contact with or separate from said face through said cap holder, said cap lever having a convex spherical portion, a stop portion engaged by said stop portions of said cap holder, and a mating portion for mating with said communication port of said cap, wherein said suction system includes a cylinder and an ink absorbing member which is disposed in an ink exhausting portion within said cylinder.

7. A cap member according to claim 6, wherein said ink absorbing member is formed of a polyolefine sintered body.

8. A cap member according to claim 6, wherein said cap lever has a rigid ink communication portion having an outer diameter smaller than an inner diameter of said ink communication portion of said cap on a central portion of a front face of said cap lever.

9. A cap member according to claim 1, wherein said groove is formed of an elastic material integrally with an ink communication portion of said cap for communicating with said suction system.

10. A suction recovery device for use in an ink jet recording apparatus, said device comprising:

a cap contactable with or separable from a face formed with a discharge port for discharging ink to record, said cap having a groove provided in an inner surface of said cap opposed to said face so as to collect ink within said cap a tapered surface continuing from said groove to narrow a space within said cap toward said groove and a communication port opening at a portion of an inner surface of said groove to communicate said groove with said suction recovery device; and a suction system for performing a suction recovery through said discharge port and through said cap, said suction system communicating with said cap through said communication port;

wherein said groove guides the collected ink to said communication port.

11. A suction recovery device according to claim 10, wherein a width of said groove portion is not less than 0.4 mm and is not greater than 0.7 mm.

12. A suction recovery device according to claim 10, wherein said suction system has a cylinder and a piston reciprocating within said cylinder.

13. A suction recovery device according to claim 10, wherein said groove is provided on said inner surface of said cap recessed from a contact surface of said cap placed into contact with said face, and said inner surface extending from said contact surface to said groove is formed as a continuously tapered face.

14. A suction recovery device according to claim 10, wherein said inner surface of said cap is formed with a tapered cavity which tapers toward said communication port.

15. A suction recovery device according to claim 10, further comprising:

a cap holder for holding said cap, said cap holder having a concave spherical portion for equalizing a contact of said cap with respect to said face and a pair of stop portions provided on an outer confronted face portion of said cap holder, each of said stop portions having an end portion with a disk-like portion thereon; and a cap lever for allowing said cap to contact with or separate from said face through said cap holder, said cap lever having a convex spherical portion, a stop portion engaged by said stop portions of said cap holder, and a mating portion for mating with said communication port of said cap, wherein said suction system includes a cylinder and an ink absorbing member which is disposed in an ink exhausting portion within said cylinder.

16. A suction recovery device according to claim 15, wherein said ink absorbing member is formed of a polyolefine sintered body.

17. A suction recovery device according to claim 15, wherein said cap lever has a rigid ink communication portion having an outer diameter smaller than an inner diameter of said ink communication portion of said cap on a central portion of a front face of said cap lever.

18. An ink jet recording apparatus comprising:

a cap member for a suction recovery device with a suction system of said ink jet recording apparatus, having a cap contactable with or separable from a face formed with a discharge port for discharging ink to record, said cap communicating with the suction system for performing a suction recovery through said discharge port and through said cap, said cap having a groove provided in an inner surface of said cap opposed to said face so as to collect ink within said cap, a tapered surface continuing from said groove to narrow a space within said cap toward said groove and a communication port opening at a portion of an inner surface of said groove to communicate said groove with said suction recovery device; and a mounting section for mounting an ink jet recording head and said cap member for said suction recovery device, wherein said groove guides the collected ink to said communication port.

19. An ink jet recording apparatus according to claim 18, wherein a width of said groove is not less than 0.4 mm and is not greater than 0.7 mm.

20. An ink jet recording apparatus according to claim 18, wherein said suction system has a cylinder an a piston reciprocating within said cylinder.

21. An ink jet recording apparatus according to claim 18, wherein said groove is provided on said inner surface of said cap recessed from a contact surface of said cap placed into contact with said face, and said inner surface extending from said contact surface to said groove is formed as a continuously tapered face.

22. An ink jet recording apparatus according to claim 18, wherein said inner of said cap is formed with a tapered cavity which tapers toward said communication port.

23. An ink jet recording apparatus according to claim 18, further comprising:

a cap holder for holding said cap, said cap holder having a concave spherical portion for equalizing a contact of said cap with respect to said face and a pair of stop portions provided on an outer confronted face portion of said cap holder, each of said stop portions having an end portion with a disk-like portion thereon; and a cap lever for allowing said cap to contact with or separate from said face through said cap holder, said cap lever having a convex spherical portion, a stop portion engaged by said stop portions of said cap holder, and a mating portion for mating with said communication port of said cap, wherein said suction system includes a cylinder and an ink absorbing member which is disposed in an ink exhausting portion within said cylinder.

24. An ink jet recording apparatus according to claim 23, wherein said ink absorbing member is formed of a polyolefine sintered body.

25. An ink jet recording apparatus according to claim 23, wherein said cap lever has a rigid ink communication portion having an outer diameter smaller than an inner diameter of said ink communication portion of said cap on a central portion of a front face of said cap lever.

26. An ink jet recording apparatus according to claim 18, wherein said groove is formed of an elastic material integrally with an ink communication portion of said cap for communicating with said suction system.

27. An ink jet recording apparatus comprising:

a cap member for a suction recovery device with a suction system of said ink jet recording apparatus, having a cap contactable with or separable from a face formed with a discharge port for discharging ink to record, said cap communicating with the suction system for performing a suction recovery through said discharge port and through said cap, said cap having a groove provided in an inner surface of said cap opposed to said face so as to collect ink within said cap, a tapered surface continuing from said groove to narrow a space within said cap toward said groove and a communication port opening at a portion of an inner surface of said groove to communicate said groove with said suction recovery device; and an ink jet recording head for discharging the ink through said discharge port, wherein said groove guides the collected ink to said communication port.

28. An ink jet recording apparatus according to claim 27, wherein a width of said groove is not less than 0.4 mm and is not greater than 0.7 mm.

29. An ink jet recording apparatus according to claim 27, wherein said suction system has a cylinder and a piston reciprocating within said cylinder.

30. An ink jet recording apparatus according to claim 27, wherein said groove is provided on said inner surface of said cap recessed from a contact surface of said cap placed into contact with said face, and said inner surface extending from said contact surface to said groove is formed as a continuously tapered face.

31. An ink jet recording apparatus according to claim 27, wherein said inner of said cap is formed with a tapered cavity which tapers toward said communication port.

32. An ink jet recording apparatus according to claim 27, further comprising:

a cap holder for holding said cap, said cap holder having a concave spherical portion for equalizing a contact of said cap with respect to said face and a pair of stop portions provided on an outer confronted face portion of said cap holder, each of said stop portions having an end portion with a disk-like portion thereon; and a cap lever for allowing said cap to contact with or separate from said face through said cap holder, said cap lever having a convex spherical portion, a stop portion engaged by said stop portions of said cap holder, and a mating portion for mating with said communication port of said cap, wherein said suction system includes a cylinder and an ink absorbing member which is disposed in an ink exhausting portion within said cylinder.

33. An ink jet recording apparatus according to claim 32, wherein said ink absorbing member is formed of a polyolefine sintered body.

34. An ink jet recording apparatus according to claim 32, wherein said cap lever has a rigid ink communication portion having an outer diameter smaller than an inner diameter of said ink communication portion of said cap on a central portion of a front face of said cap lever.

35. An ink jet recording apparatus according to claim 27, wherein said groove is formed of an elastic material integrally with an ink communication portion of said cap for communicating with said suction system.

36. A suction recovery method for an ink jet recording apparatus, comprising the steps of:

contacting a cap with a face formed with a discharge port for discharging ink to record;

sucking the ink by a suction system through said discharge port through said cap;

collecting the ink within said cap in a groove in an inner surface of said cap opposed to said face; and guiding the collected ink to a communication port opening at a portion of an inner surface of said groove to communicate said groove with said suction system, wherein said cap has a tapered surface continuing from said groove to narrow a space within said cap toward said groove.

37. A suction recover method according to claim 36, wherein a width of said groove is not less than 0.4 mm and is not greater than 0.7 mm.

38. A suction recovery method according to claim 36, wherein said suction system has a cylinder and a piston reciprocating within said cylinder.

39. A suction recovery method according to claim 36, wherein said groove is provided on said inner surface of said cap recessed from a contact surface of said cap placed into contact with said face, and said inner surface extending from said contact surface to said groove is formed as a continuously tapered face.

40. A suction recovery method according to claim 36, wherein said inner of said cap is formed with a tapered cavity which tapers toward said communication port.

41. A suction recovery method according to claim 36, further comprising the steps of:

providing a cap holder for holding said cap, said cap holder having a concave spherical portion for equalizing a contact of said cap with respect to said face and a pair of stop portions provided on an outer confronted face portion of said cap holder, each of said stop portions having an end portion with a disk-like portion thereon; and providing a cap lever for allowing said cap to contact with or separate from said face through said cap holder, said cap lever having a convex spherical portion, a stop portion engaged by said stop portions of said cap holder, and a mating portion for mating with said communication port of said cap, wherein said suction system includes a cylinder and an ink absorbing member which is disposed in an ink exhausting portion within said cylinder.

42. A suction recovery method according to claim 4, wherein said ink absorbing member is formed of a polyolefine sintered body.

43. A suction recovery method according to claim 41, wherein said cap lever has a rigid ink communication portion having an outer diameter smaller than an inner diameter of said ink communication portion of said cap on a central portion of a front face of said cap lever.

44. A suction recovery method according to claim 36, wherein said sucking of the ink is performed by reciprocating a piston within a cylinder.

45. A suction recovery method according to claim 36, wherein said cap has a contacting surface and said groove portion is recessed therefrom.

46. A suction recovery method according to claim 36, wherein said cap is held by a cap holder and the contacting in said contacting step is performed by a cap lever, and in said sucking step the ink is sucked through an ink absorbing member.

47. A cap member according to claim 1, wherein said groove collects the ink within said cap using a surface tension of the ink.

48. A suction recovery device according to claim 10, wherein said groove collects the ink within said cap using a surface tension of the ink.

49. An ink jet recording apparatus according to claim 18, wherein said groove collects the ink within said cap using a surface tension of the ink.

50. An ink jet recording apparatus according to claim 27, wherein said groove collects the ink within said cap using a surface tension of the ink.

51. A suction recovery method according to claim 36, wherein said groove collects the ink within said cap using a surface tension of the ink.

* * * * *

UNITED STATES PATENT AND TRADEMARK OFFICE

CERTIFICATE OF CORRECTION

PATENT NO. : 5,717,444

DATED : February 10, 1998

INVENTOR(S) : Hitoshi Sugimoto, et al.

It is certified that error appears in the above-identified patent and that said Letters Patent is hereby corrected as shown below:

In the Abstract

Lines 6 and 10, change "said" to --the--; and
line 11, change "ink" to --an ink--.

Column 1

Line 18, change "(thereafter" to --(hereafter--.

Column 2

Line 29, change "clearingly" to --clearing--; and
line 40, change "cleanest" to --cleared--.

Column 3

Line 12, change "clearing" to --by clearing--; and
line 13, change "discharging" to --by discharging".

Column 4

Line 16, change "FIG. 23A" to --FIGS. 23A--; and
line 21, delete "a".

Column 5

Line 20, delete "of"; and
line 44, change "And the" to --~~The~~--.

UNITED STATES PATENT AND TRADEMARK OFFICE

CERTIFICATE OF CORRECTION

PATENT NO. : 5,717,444

DATED : February 10, 1998

INVENTOR(S) : Hitoshi Sugimoto, et al.

It is certified that error appears in the above-identified patent and that said Letters Patent is hereby corrected as shown below:

Column 6

Line 1, change "member" to --a member--;
line 17, delete "acting";
line 44, delete "are" and "to"
line 46, change "which is corresponding" to --for use with--; and
line 47, change "to" to --a--.

Column 7

Line 14, change "position" to --positions--, and change "sheet" to --sheets--;
line 39, delete the second occurrence of "13"; and
line 53, change the second occurrence of "recovery" to --recording--.

Column 8

Line 3, change "parallel" to --parallel to--;
line 8, delete "1", and change "as" to --(as--;
line 9, change "(will" to --will--; and
line 48, change "assembler boots" to --by assembler robot(s)--.

UNITED STATES PATENT AND TRADEMARK OFFICE

CERTIFICATE OF CORRECTION

PATENT NO. : 5,717,444

DATED : February 10, 1998

INVENTOR(S) : Hitoshi Sugimoto, et al.

It is certified that error appears in the above-identified patent and that said Letters Patent is hereby corrected as shown below:

Column 10

Line 32, change "piston," to --the piston,--; and
line 57, change "face." to --faces.--.

Column 11

Line 9, change "position)" to --portion)--.

Column 14

Line 10, change "collar $21_h$" to --collar 21h--; and
line 49, change "that" to --those--.

Column 15

Line 15, change "(thereafter" to --(hereafter--;
line 20, change "precharges" to --predischarges--; and
line 31, change "FIGS. 14B" to --FIG. 14B--.

Column 16

Line 21, change "pressed;" to --pressed--;
line 41, change "note" to --noted--; and
line 50, change "At" to --As--.

Column 19

Line 8, change "cylinder" to --cylinder 24,--.

UNITED STATES PATENT AND TRADEMARK OFFICE

CERTIFICATE OF CORRECTION

PATENT NO. : 5,717,444

DATED : February 10, 1998

INVENTOR(S) : Hitoshi Sugimoto, et al.

It is certified that error appears in the above-identified patent and that said Letters Patent is hereby corrected as shown below:

Column 21

Line 3, change "made in placed" to --placed in--.

Column 22

Line 29, change "a" to --an--.

Column 23

Line 20, change reference numeral "106" to --1006--;
line 29, change "the-suction" to --the suction--;
line 39, change "can" to --can take--;
line 40, delete "various";
line 44, delete "5"; and
line 59, change "saddle 156," to --saddle 1156,--.

Column 24

Line 4, change "port 1222" to --port 722--;
line 5, change "cap 1222" to --cap 1022--;
line 15, delete "and";
line 18, change "mucleate" to --nucleate--; and
line 50, change "electricity-heat" to --electrothermal--.

UNITED STATES PATENT AND TRADEMARK OFFICE

CERTIFICATE OF CORRECTION

PATENT NO. : 5,717,444

DATED : February 10, 1998

INVENTOR(S) : Hitoshi Sugimoto, et al.

It is certified that error appears in the above-identified patent and that said Letters Patent is hereby corrected as shown below:

Column 26

Line 7, delete "portion".
line 54, change "cap" to --cap,--; and
line 66, delete "portion".

Column 28

Line 4, change "inner" to --inner surface--; and
line 66, change "inner" to --inner surface--.

Column 30

Line 2, change "inner" to --inner surface--;
line 21, change "claim 4," to --claim 41,--; and
line 34, delete "portion".

Signed and Sealed this

Twenty-seventh Day of February, 2001

Attest:

Nicholas P. Godici

NICHOLAS P. GODICI

Attesting Officer

Acting Director of the United States Patent and Trademark Office